US008081904B2

(12) United States Patent
Ohkubo et al.

(10) Patent No.: US 8,081,904 B2
(45) Date of Patent: Dec. 20, 2011

(54) BELT DRIVE CONTROL UNIT, BELT DRIVE CONTROL METHOD, BELT DRIVE CONTROL PROGRAM, AND IMAGE FORMING APPARATUS USING SAME

(75) Inventors: Hiroki Ohkubo, Yokohama (JP); Hiromichi Matsuda, Isehara (JP); Toshiyuki Andoh, Sagamihara (JP); Yuji Matsuda, Inagi (JP); Yuichiro Ueda, Zama (JP); Kazuhiko Kobayashi, Tokyo (JP); Takuya Uehara, Tokyo (JP); Takuya Murata, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 369 days.

(21) Appl. No.: 12/361,969

(22) Filed: Jan. 29, 2009

(65) Prior Publication Data

US 2009/0190972 A1 Jul. 30, 2009

(30) Foreign Application Priority Data

Jan. 30, 2008 (JP) ..... 2008-019468
May 28, 2008 (JP) ..... 2008-139945
Jan. 27, 2009 (JP) ..... 2009-015565

(51) Int. Cl.
*G03G 15/00* (2006.01)

(52) U.S. Cl. ..... 399/162

(58) Field of Classification Search ..... 399/162, 399/198, 301
See application file for complete search history.

(56) References Cited

U.S. PATENT DOCUMENTS

| | | | | |
|---|---|---|---|---|
| 7,372,479 | B2 | 5/2008 | Ohkubo | |
| 7,871,073 | B2 * | 1/2011 | Noguchi et al. | 271/265.01 |
| 7,937,007 | B2 * | 5/2011 | Kobayashi et al. | 399/49 |
| 7,970,317 | B2 * | 6/2011 | Seto | 399/167 |
| 2008/0247781 | A1 * | 10/2008 | Matsuda et al. | 399/162 |
| 2009/0238613 | A1 * | 9/2009 | Ueda et al. | 399/301 |

FOREIGN PATENT DOCUMENTS

| | | | |
|---|---|---|---|
| JP | 2754582 | | 3/1998 |
| JP | 2820433 | | 8/1998 |
| JP | 2002-72816 | | 3/2002 |
| JP | 2004123383 | A * | 4/2004 |
| JP | 3658262 | | 3/2005 |
| JP | 2006-23403 | | 1/2006 |
| JP | 2006-106642 | | 4/2006 |

* cited by examiner

*Primary Examiner* — David Gray
*Assistant Examiner* — Frederick Wenderoth
(74) *Attorney, Agent, or Firm* — Oblon, Spivak, McClelland, Maier & Neustadt, L.L.P.

(57) ABSTRACT

A belt drive control unit controls a rotation of belt supported by first and second rollers. Each of rotations of the first and second rollers are detected as first and second results. A rotation of the first roller is controlled in connection with thickness fluctuation in the belt using the first and second results. The belt drive control unit includes a sampling data acquisition unit, a correction value generator, a correction value storage, and a correction value reading controller. The sampling data acquisition unit obtains sampling data by sampling a difference value between the first and second results. The correction value generator generates correction value data for the belt based on the sampling data. The correction value storage stores the correction value data. The correction value reading controller reads the correction value data based on a rotation number of the belt to control a rotation of the first roller.

9 Claims, 15 Drawing Sheets

FIG. 11

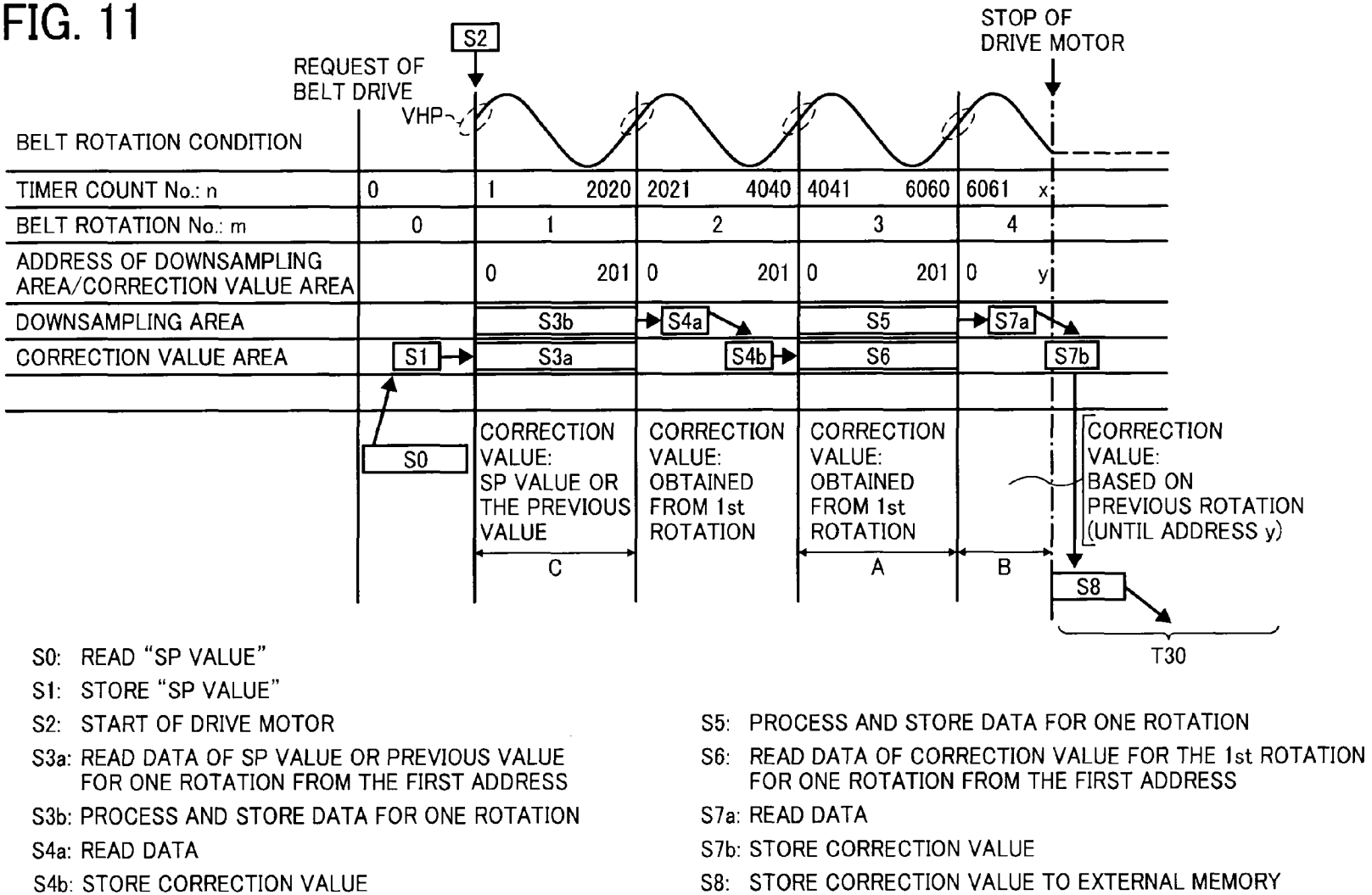

S0: READ "SP VALUE"

S1: STORE "SP VALUE"

S2: START OF DRIVE MOTOR

S3a: READ DATA OF SP VALUE OR PREVIOUS VALUE FOR ONE ROTATION FROM THE FIRST ADDRESS

S3b: PROCESS AND STORE DATA FOR ONE ROTATION

S4a: READ DATA

S4b: STORE CORRECTION VALUE

S5: PROCESS AND STORE DATA FOR ONE ROTATION

S6: READ DATA OF CORRECTION VALUE FOR THE 1st ROTATION FOR ONE ROTATION FROM THE FIRST ADDRESS

S7a: READ DATA

S7b: STORE CORRECTION VALUE

S8: STORE CORRECTION VALUE TO EXTERNAL MEMORY

FIG. 15

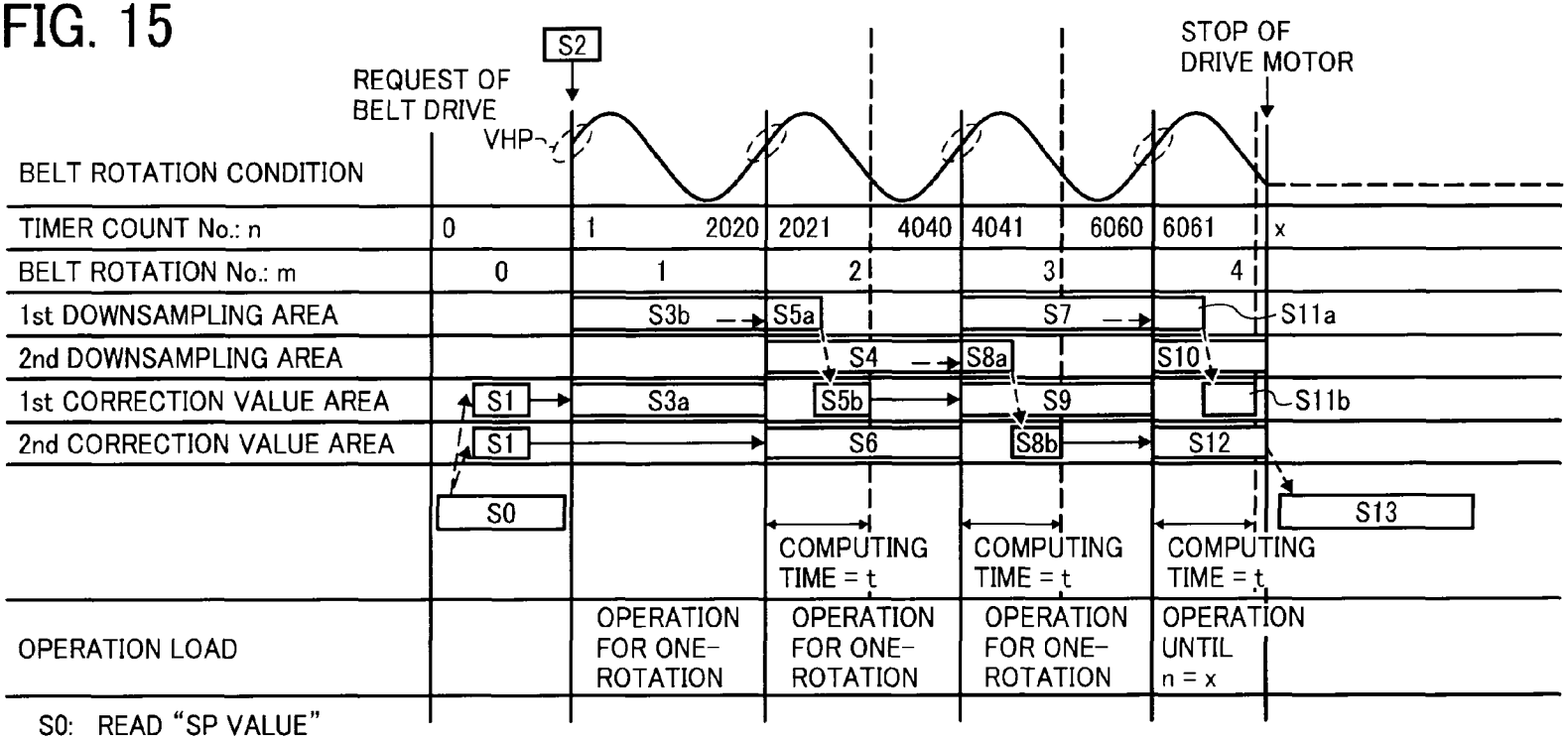

S0: READ "SP VALUE"
S1: STORE "SP VALUE"
S2: START OF DRIVE MOTOR
S3a: READ DATA OF SP VALUE OR THE PREVIOUS VALUE FOR ONE ROTATION FROM THE FIRST ADDRESS
S3b: PROCESS AND STORE DATA FOR ONE ROTATION
S4: PROCESS AND STORE DATA FOR ONE ROTATION
S5a: COMPUTE AMPLITUDE AND PHASE VALUE
S5b: STORE CORRECTION VALUE
S6: READ DATA OF SP VALUE OR THE PREVIOUS VALUE FOR ONE ROTATION FROM THE FIRST ADDRESS
S7: PROCESS AND STORE DATA FOR ONE ROTATION
S8a: COMPUTE AMPLITUDE AND PHASE VALUE
S8b: STORE CORRECTION VALUE
S9: READ CORRECTION VALUE FOR ONE ROTATION FROM THE FIRST ADDRESS
S10: PROCESS DATA UNTIL MEMORY ADDRESS "n" = x
S11a: COMPUTE AMPLITUDE AND PHASE VALUE
S11b: STORE CORRECTION VALUE
S12: READ CORRECTION VALUE FROM THE FIRST ADDRESS TO MEMORY ADDRESS "n" = x
S13: STORE CORRECTION VALUE TO EXTERNAL MEMORY

FIG. 16

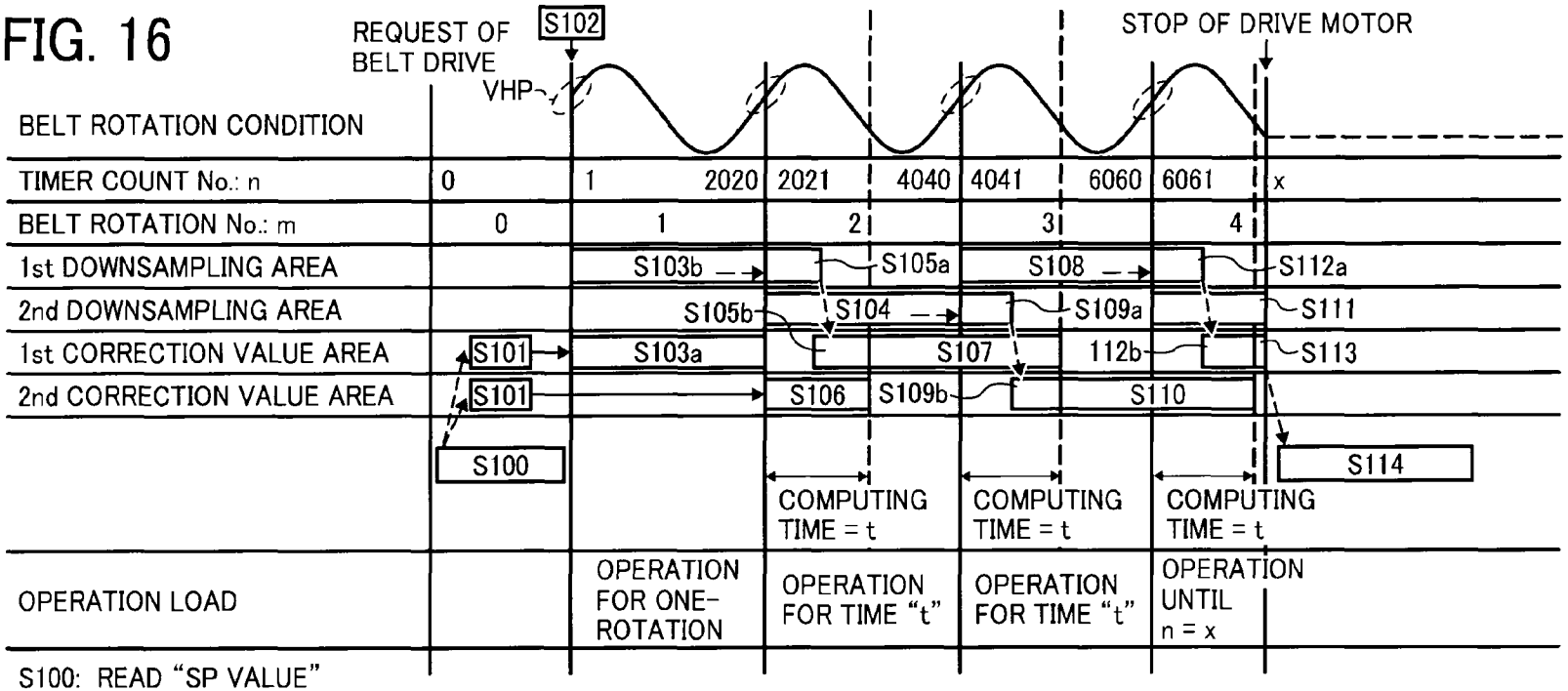

S100: READ "SP VALUE"
S101: STORE "SP VALUE"
S102: START OF DRIVE MOTOR
S103a: READ DATA OF CORRECTION VALUE FOR ONE ROTATION FROM THE FIRST ADDRESS
S103b: PROCESS AND STORE DATA FOR ONE ROTATION
S104: PROCESS AND STORE DATA FOR ONE ROTATION
S105a: COMPUTE AMPLITUDE AND PHASE VALUE
S105b: STORE CORRECTION VALUE
S106: READ DATA OF CORRECTION VALUE FROM THE FIRST MEMORY ADDRESS TO MEMORY ADDRESS CORRESPONDING TO THE TIME "t"
S107: READ CORRECTION VALUE FOR ONE ROTATION FROM MEMORY ADDRESS CORRESPONDING TO THE TIME "t"
S108: PROCESS AND STORE DATA FOR ONE ROTATION
S109a: COMPUTE AMPLITUDE AND PHASE VALUE
S109b: STORE CORRECTION VALUE
S110: READ CORRECTION VALUE FOR ONE ROTATION FROM MEMORY ADDRESS CORRESPONDING TO THE TIME "t"
S111: PROCESS AND STORE DATA UNTIL MEMORY ADDRESS "n" = x
S112a: COMPUTE AMPLITUDE AND PHASE VALUE
S112b: STORE CORRECTION VALUE
S113: READ CORRECTION VALUE FROM MEMORY ADDRESS FOR THE TIME "t" TO MEMORY ADDRESS CORRESPONDING TO "n" = x
S114: STORE CORRECTION VALUE TO EXTERNAL MEMORY

BELT DRIVE CONTROL UNIT, BELT DRIVE CONTROL METHOD, BELT DRIVE CONTROL PROGRAM, AND IMAGE FORMING APPARATUS USING SAME

CROSS-REFERENCE TO RELATED APPLICATIONS

This application claims priority under 35 U.S.C. 119(a) to Japanese Patent Application Nos. 2008-019468, filed on Jan. 30, 2008, 2008-139945, filed on May 28, 2008, and 2009-015565, filed on Jan. 27, 2009 in the Japan Patent Office, the entire contents of each of which are hereby incorporated by reference herein.

BACKGROUND OF THE INVENTION

1. Field of the Invention

The present disclosure generally relates to an image forming apparatus including a belt extended by a plurality of rotatable supporters and a belt drive control unit for controlling a driving of the belt, and a program for a belt drive control unit.

2. Description of the Background Art

Typically, image forming apparatuses employ either a direct transfer method or an indirect transfer method for forming a color image on a recording medium. In the direct transfer method, toner images formed on a plurality of photoconductors are directly transferred to a transfer sheet. In the indirect transfer method, toner images formed on a plurality of photoconductors are transferred to an intermediate transfer member, and then transferred to a transfer sheet.

Such image forming apparatuses include a plurality of photoconductors, arranged in tandem, for forming latent toner images of yellow (Y), magenta (M), cyan (C), and black (K) and for developing the latent images thereon. Such plurality of photoconductors is disposed so as to face a transfer sheet or an intermediate transfer member. Toner images are transferred from the photoconductors to the transfer sheet, moving in one direction, in the direct transfer method, or to an intermediate transfer member, moving in one direction, in the indirect transfer method.

In such image forming apparatuses, an endless belt is used to support and move the transfer sheet in the direct transfer method, and to receive toner images from the photoconductors in the indirect transfer method. Four photoconductors may be arranged along the endless belt (e.g., transfer belt).

In such image forming apparatuses, color-to-color displacement may occur if a moving (or traveling) velocity of the endless belt cannot be kept constant. Color-to-color displacement may be observed as incorrect superimposing of different color images, which causes image failure. Consequently, a high precision drive control of the endless belt is required to move the endless belt at a constant velocity so that color-to-color displacement caused by fluctuations in moving velocity can be prevented.

Typically, such endless belt is extended by a drive roller and a plurality of driven rollers, and one of the driven rollers provided with an encoder that detects fluctuations in rotation speed of the driven roller. Such information is then used to adjust rotation speed of the drive roller to prevent the color-to-color displacement caused by speed fluctuation in the endless belt. Such adjustment may be referred to as feedback control.

Such feedback control is typically accomplished using phase-locked-loop control (hereinafter, "PLL control"). In PLL control, a difference between a target angular velocity of the drive motor and a detected angular velocity of the encoder is computed as angular velocity error, and then a drive pulse frequency for the drive motor is adjusted by applying a control gain, by which the endless belt can be moved at a target speed.

Specifically, when a transport speed of the endless belt for some reason fluctuates, PLL control is conducted so that the transport speed of the endless belt can be adjusted to a preferred speed which can be detected by the encoder, and the encoder outputs a pulse signal to move the endless belt at a constant speed. In general, fluctuation in the transport speed of the endless belt is due to cyclical variation in a support roller or cyclical variation in a roller contacting an outer face of the endless belt, for example.

However, such control may not be effective for keeping the transport speed of the endless belt constant because fluctuation or variation in a thickness of the endless belt, which may be small in absolute terms, nevertheless may be sufficiently large to cause the transport speed of the endless belt to fluctuate. If a transport speed of transfer sheet or intermediate transfer member fluctuates, image quality may be degraded, and images cannot be produced reliably on the transfer sheet because an image-receiving position on the target transfer sheet or the intermediate transfer member may deviate due to such fluctuation. Further, such fluctuation in transport speed may cause undesirable effects when images are reproduced on multiple transfer sheets. Exactly why these things happen can be explained by examining the structure of the transport mechanism in detail, as is done below.

As shown in FIG. 1, it can be assumed that the transport speed V of the endless belt can be determined with reference to a point located at a center portion in a thickness direction of the endless belt at a position where the endless belt is driven by a drive roller, in which the transport speed V can be defined by equation (1), $$V=(R+B/2)\times\omega \tag{1}$$

in which "R" is the radius of the drive roller, "B" is the thickness of endless belt, and "ω" is angular velocity of the drive roller. If the belt thickness B varies, then a position of an effective thickness line of the endless belt (belt effective thickness line), shown in FIG. 1 as a dotted line, changes. If the position of the belt effective thickness line changes, then an effective radius of the endless belt also changes, by which (R+B/2) in the equation (1) changes. Accordingly, even if the angular velocity of the drive roller "ω" is set to a constant value, the transport speed of the endless belt varies. Accordingly, even if the drive roller is rotated at a constant angular velocity, the transport speed of the endless belt varies if the thickness of the endless belt varies. FIG. 2 illustrates a schematic configuration of the endless belt, in which a belt 1010 is extended by a drive roller 1015 and driven rollers 1014 and 1016.

FIG. 3 illustrates a relation between a thickness fluctuation or variation of the belt 1010 along an entire length of the endless belt 1010 and a transport speed fluctuation or variation of the endless belt 1010 when the drive roller 1015 is rotated at a constant angular velocity. As a thicker part of the belt 1010 winds around the drive roller 1015, an effective radius of the belt (see FIG. 1) is increased, by which the transport speed of the endless belt also increases as understood from the equation (1). As a thinner part of the belt 1010 winds around the drive roller 1015, an effective radius of the belt 1010 (see FIG. 1) is decreased, by which the transport speed of the belt 1010 also decreases as understood from the equation (1).

Further, FIG. 4 illustrates a relation between a thickness fluctuation or variation of the belt 1010 at the driven roller 1014 and a transport speed fluctuation or variation of the belt 1010 detected at the driven roller 1014 when the belt 1010 moves at a constant transport speed. As a thicker part of the belt 1010 winds onto the driven roller 1014, the effective radius of the belt 1010 at the driven roller 1014 is increased, by which the angular velocity of the driven roller 1014 decreases, by which the transport speed of the belt 1010 also decreases as understood from the equation (1). By contrast, as a thinner part of the belt 1010 winds on the driven roller 1014, an effective radius of the belt 1010 at the driven roller 1014 is decreased, by which the angular velocity of the driven roller 1014 increases, by which the transport speed of the belt 1010 also increases as understood from the equation (1).

If the thickness fluctuation in the belt 1010 is confirmed along the entire length of the belt 1010, a transport speed of the belt 1010 detected by an encoder disposed at a shaft of the driven roller 1014 may be a detection error deviated from a target speed.

Therefore, even if the belt 1010 moves at a constant speed, the detection results of the encoder may indicate that a transport speed of the belt 1010 varies from the target speed because variation in angular velocity of the driven roller 1014 is detected due to a thickness fluctuation in the belt 1010 along the entire length of the belt 1010. Accordingly, a conventional feedback control using the driven roller may not be effective in view of a thickness fluctuation in the belt because the speed detection results may falsely indicate a speed fluctuation in the endless belt.

Some related-art approaches for remedying the above-described problem disclose methods for precisely controlling rotation of a belt, in which a drive roller for driving the belt or a driven roller driven with the belt are controlled as below described.

JP-2000-310897-A (reference 1) discloses an image forming apparatus including a transfer belt extended by a drive roller and a driven roller. The transfer belt has a mark to detect the position of the transfer belt movable in one direction. When the drive roller is activated at a constant pulse rate, a transfer belt thickness profile ("thickness fluctuation in the transfer belt") is obtained along the entire length of the transfer belt. Such thickness fluctuation in the transfer belt may cause a transport speed variation Vh. Then, a "transfer belt speed deviation" (transfer belt speed profile) which can compensate for the transport speed variation Vh is computed and a control signal for the drive motor is generated from a modified pulse rate based on such computation, with the drive motor driven to rotate the transfer belt using the drive roller. Accordingly, a transfer belt speed Vb of the transfer belt can be kept constant.

However, in reference 1, data of speed fluctuation in the transfer belt needs to be collected for each belt rotation. If a control cycle is set short, a large capacity memory may be needed, whereas if the control cycle is set long, feedback control may not be conducted effectively. For example, if the transfer belt has a circumference length of 815 mm, a belt speed of 125 mm/s, and a control cycle of 1 ms, the speed control may be conducted 6520 times per rotation of the transfer belt (815 mm/(125 mm/s×1 ms)=6520 times). Further, if data size of transfer belt thickness per one control is set to 16-bit to improve the control precision, a memory having 100 k bit may be required (6520×16 bit=104,320 bit).

When such speed control is conducted, a memory (e.g., non-volatile memory) may be required for storing data of thickness fluctuation in the transfer belt. Accordingly, even if the data is compressed for storing, and decompressed to a volatile memory when the power is set ON, a larger capacity memory may be required. Accordingly, in addition to a memory used as a working area, another memory may also be required, which increases a total cost of the apparatus.

Further, a thickness fluctuation in the transfer belt may need to be measured as thickness data of the transfer belt, in which a laser displacement gauge may be used. The measured data is input to an image forming apparatus when shipping products or when a service engineer checks an image forming apparatus using an operation panel or the like. However, the thickness fluctuation in the transfer belt needs to be measured at a higher precision of several micrometers (μm) or so, and an input error may occur when inputting data because the amount of measured data may become great.

In view of such drawbacks of reference 1, JP-2006-106642-A (reference 2) discloses an image forming apparatus including a belt drive control unit. A drive motor outputs a drive input signal to a converter unit, in which the drive input signal is converted to angular velocity of a driven roller. A comparison unit compares a drive output signal and the drive input signal (converted by the converter unit) to obtain fluctuation composition caused by thickness fluctuation in one rotation of the belt. Then, a periodic fluctuation sampling unit stores the fluctuation composition caused by thickness fluctuation per rotation of the belt to a memory. An amplitude and phase detector detects amplitude and phase of the belt in a rotation cycle using the fluctuation composition per one rotation of the belt stored in the memory.

Reference 2 discloses an image forming apparatus having a belt unit and a belt drive control unit, which can conduct a belt drive control process during an image forming process, in which amplitude and phase of a belt corresponding to a cyclical thickness fluctuation in the belt can be extracted based on angular velocity or rotation angle displacement having a given frequency.

In reference 2, a detection result at a shaft of the drive roller is subtracted from a detection result at a shaft of the driven roller shaft to obtain the belt fluctuation component having a frequency corresponding to a cyclical thickness fluctuation in the belt. Based on the belt fluctuation component, amplitude and phase of the belt can be is extracted, and a rotation of the drive roller is controlled based on such computed values.

Specifically, a periodical fluctuation component of the belt per one period starting from a virtual home position VHP of the belt can be detected and stored in a memory. The stored fluctuation component can be used to detect amplitude and phase of primary wave and higher harmonic wave. Angular velocity or rotation angle displacement detected by an encoder disposed to the driven roller can be used as belt fluctuation component corresponding to the thickness fluctuation in the belt.

However, a computation process to detect amplitude and phase using zero cross method for fluctuation component, a computation process to detect amplitude and phase of fluctuation component of a previously-determined cycle from a peak value, and a detection process for a component of a previously-determined cycle using quadrature detection all require a given time duration (or a given time-delay). Accordingly, due to such time delay, the detected amplitude and phase may not be applied to a right position of the belt, which needs to be corrected by the detected amplitude and phase. Accordingly, the computed amplitude and phase may not be applied to a right position of the belt, which needs to be corrected based on the computed amplitude and phase. In other words, the computed amplitude and phase may be applied to a position of the belt different from a to-be-corrected position.

SUMMARY

In an aspect of the present disclosure, a belt drive control unit controls a rotation movement of a belt extendedly supported by a first rotatable device and a second rotatable device. The first rotatable device is used as a drive-type rotatable device to support and rotate the belt. The drive-type rotatable device is driven by a driver. The second rotatable device is used as a driven-type rotatable device. The second rotatable device is rotatable when the belt rotates. A rotation of the drive-type rotatable device is detected by a first detector as a first detection result. A rotation of the driven-type rotatable device is detected by a second detector as a second detection result. A rotation of the drive-type rotatable device is controlled in connection with thickness fluctuation in the belt at the driven-type rotatable device using the first detection result and the second detection result. The belt drive control unit includes a sampling data acquisition unit, a correction value generation unit, a correction value storage device, and a correction value reading control unit. The sampling data acquisition unit obtains sampling data by sampling a difference value between the first detection result and the second detection result. The correction value generation unit generates correction value data for each number of rotations of the belt based on the sampling data, the correction value data is used to correct a rotation of the drive-type rotatable device. The correction value storage device stores the correction value data. The correction value reading control unit reads the correction value data stored in the correction value storage device at a timing determined by number of rotations of the belt for controlling a rotation of the drive-type rotatable device.

In another aspect of the present disclosure, a belt drive control method is used to control a rotation movement of a belt extendedly supported by a first rotatable device and a second rotatable device. The first rotatable device is used as a drive-type rotatable device to support and rotate the belt. The drive-type rotatable device is driven by a driver. The second rotatable device is used as a driven-type rotatable device. The second rotatable device rotatable when the belt rotates. A rotation of the drive-type rotatable device is detected by a first detector as a first detection result. A rotation of the driven-type rotatable device is detected by a second detector as a second detection result. A rotation of the drive-type rotatable device is controlled in connection with thickness fluctuation in the belt at the driven-type rotatable device using the first detection result and the second detection result. The method comprising the steps of acquiring sampling data, generating correction value data, storing correction value data, and reading correction value data. In the acquiring sampling data, a difference value between the first detection result and the second detection result are sampled to obtain sampling data. In the generating correction value data, correction value data for correcting a rotation of the drive-type rotatable device is generated according to number of rotations of the belt based on the sampling data. In storing correction value data, the correction value data generated by the generation step is stored in a correction value storage device according to number of rotations of the belt. In the reading correction value data, the correction value data stored in the correction value storage device is read according to number of rotations of the belt.

In another aspect of the present disclosure, a computer readable medium stores a program of belt drive control, comprising computer readable instructions, that when executed by a computer, that instructs a belt drive control unit to carry out a method of controlling a rotation movement of a belt extendedly supported by a first rotatable device and a second rotatable device. The first rotatable device is used as a drive-type rotatable device to support and rotate the belt. The drive-type rotatable device is driven by a driver. The second rotatable device is used as a driven-type rotatable device. The second rotatable device rotatable when the belt rotates. A rotation of the drive-type rotatable device is detected by a first detector as a first detection result. A rotation of the driven-type rotatable device is detected by a second detector as a second detection result. A rotation of the drive-type rotatable device is controlled in connection with thickness fluctuation in the belt at the driven-type rotatable device using the first detection result and the second detection result. The method comprising the steps of acquiring sampling data, generating correction value data, storing correction value data, and reading correction value data. In the acquiring sampling data, a difference value between the first detection result and the second detection result are sampled to obtain sampling data. In the generating correction value data, correction value data for correcting a rotation of the drive-type rotatable device is generated according to number of rotations of the belt based on the sampling data. In storing correction value data, the correction value data generated by the generation step is stored in a correction value storage device according to number of rotations of the belt. In the reading correction value data, the correction value data stored in the correction value storage device is read according to number of rotations of the belt.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 11 shows a timing chart for controlling a transport speed of the transfer belt in view of thickness fluctuation in the transfer belt according to a first exemplary embodiment;

FIG. 15 shows another timing chart for controlling a transport speed of the transfer belt according to the second exemplary embodiment in view of thickness fluctuation in the transfer belt;

FIG. 16 shows another timing chart for controlling a transport speed of the transfer belt according to the third exemplary embodiment in view of thickness fluctuation in the transfer belt;

Figure 1:
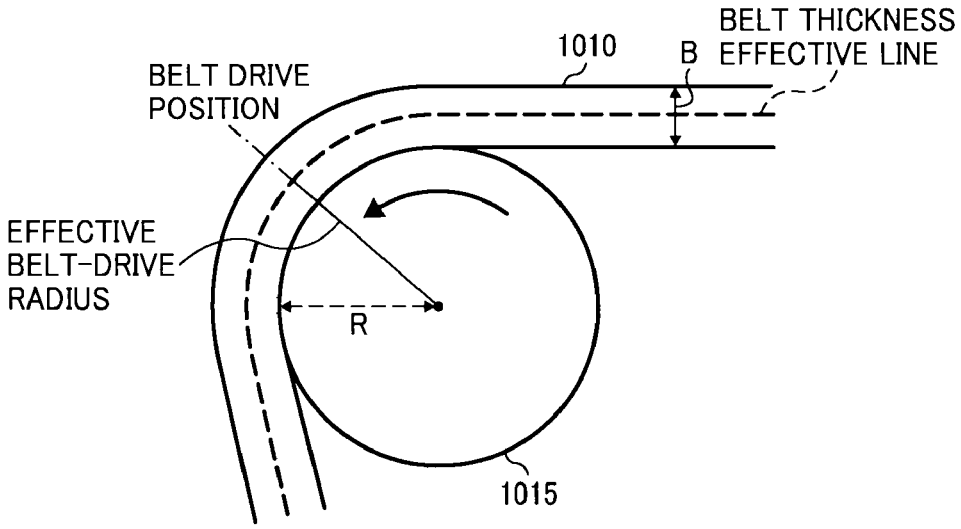
FIG. 1 illustrates an expanded view of a belt and a roller, in which a relationship of belt thickness and effective belt-drive radius is shown.
Figure 2:
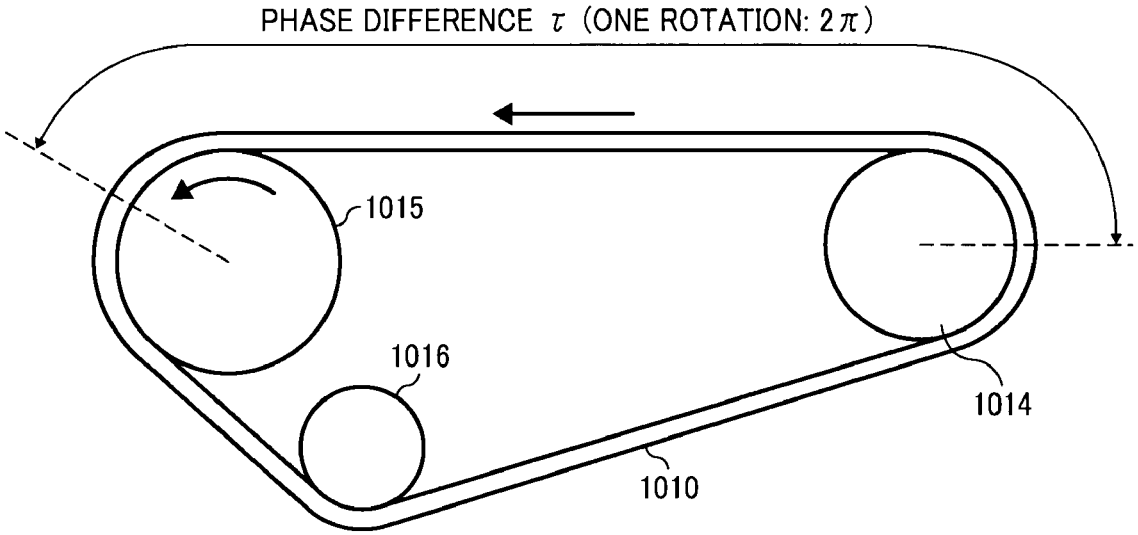
FIG. 2 illustrates a schematic configuration of a belt and rollers supporting the belt.
Figure 3:
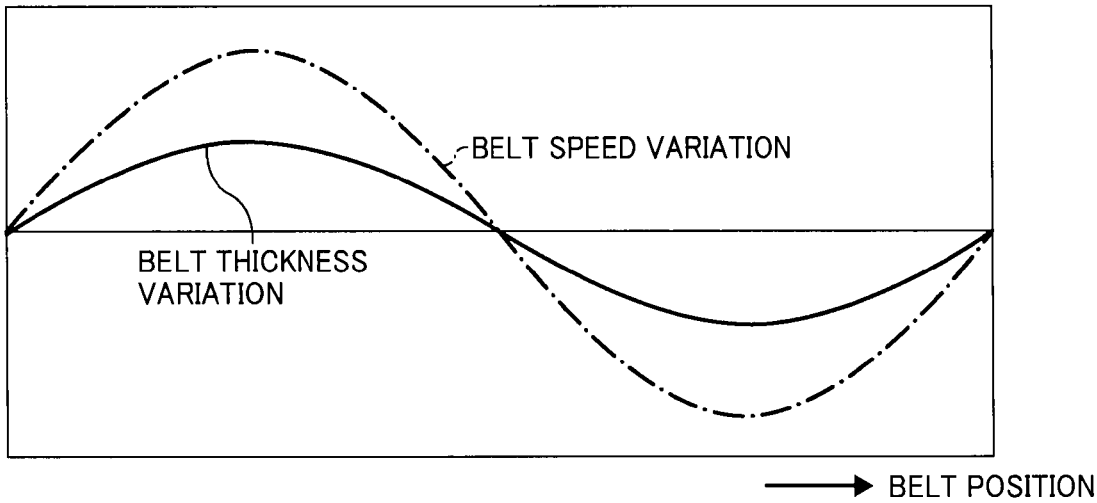
FIG. 3 shows profiles of thickness fluctuation in a belt and transport speed fluctuation in the belt at a drive roller extending the belt.
Figure 4:
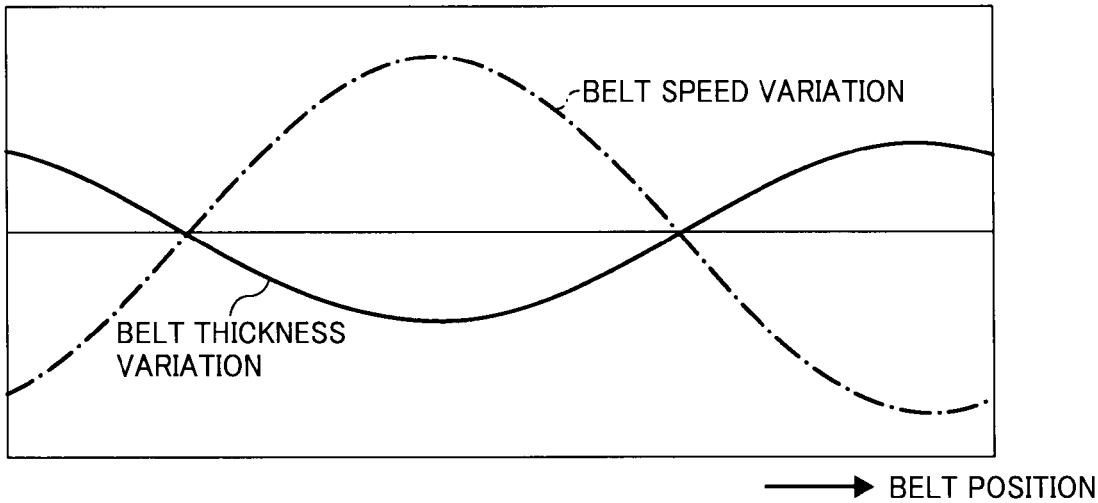
FIG. 4 shows profiles of thickness fluctuation in a belt and transport speed fluctuation in the belt at a driven roller extending the belt.

The accompanying drawings are intended to depict example embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention.

Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an example embodiment is described with reference to accompanying drawings. The image forming apparatus may employ electrophotography, a tandem arrangement, and an indirect transfer method for example, and may be used as copier, printer, facsimile, or a multi-functional apparatus, but not limited thereto.

Figure 5:
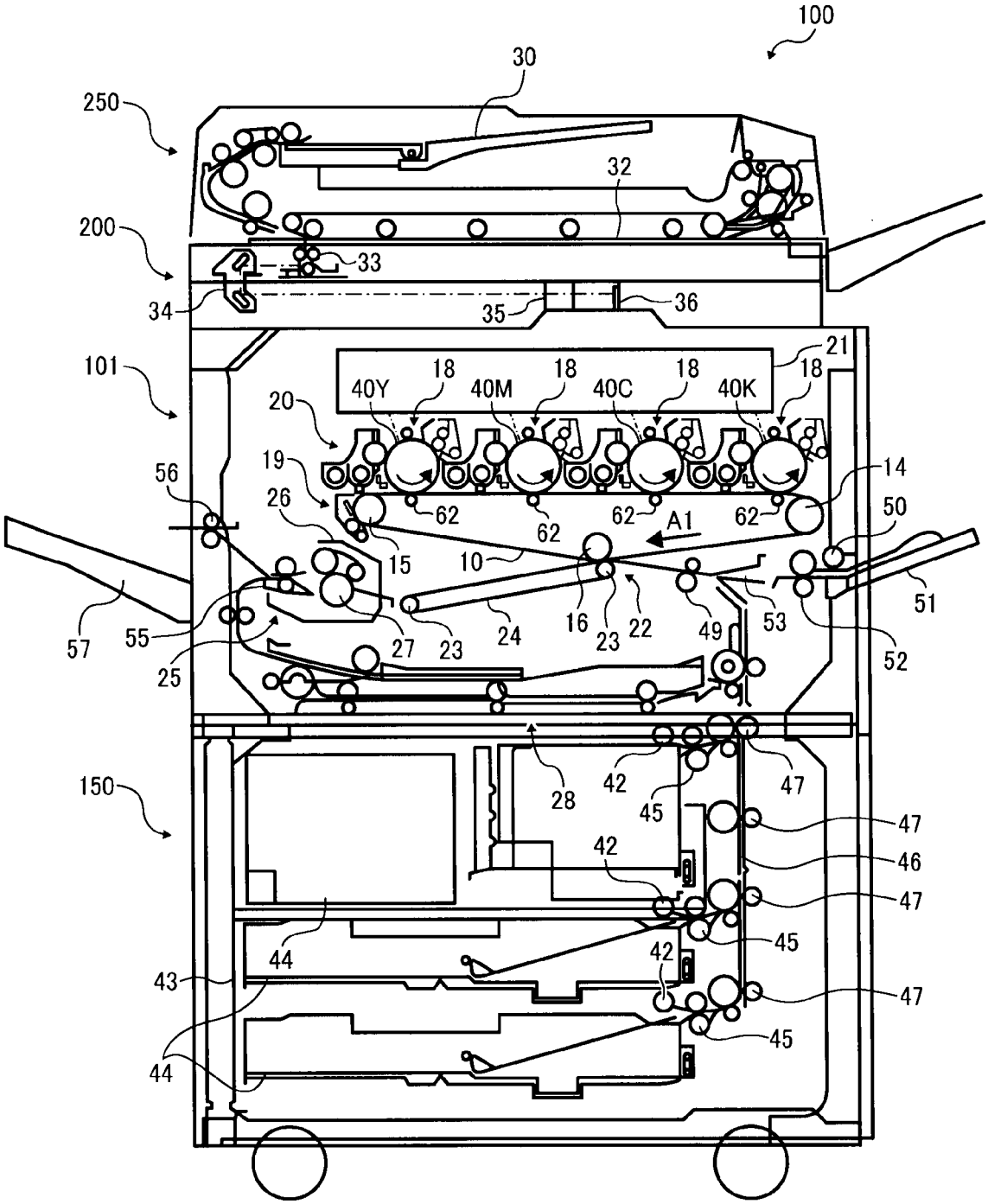
FIG. 5 illustrates a schematic configuration of an image forming apparatus according to an exemplary embodiment.

FIG. 5 illustrates a schematic configuration of an image forming apparatus 100 according to exemplary embodiments. The image forming apparatus 100 may be a copier, a printer, a facsimile, and a multi-functional apparatus, for example. When the image forming apparatus 100 is used as a printer or a facsimile, the image forming apparatus 100 conducts an image forming process using image data received from an external device, such a personal computer.

The image forming apparatus 100 includes a printing unit 101, a sheet feed unit 150, a scanner 200, and an automatic document feeder (ADF) 250, for example. The printing unit 101 may be placed over the sheet feed unit 150, the scanner 200 may be placed on the printing unit 101, and the ADF 250 may be placed on the scanner 200, for example. The ADF 250 feeds document to the scanner 200 automatically. The image forming apparatus 100 may be a digital color copier having a tandem arrangement and using indirect transfer method, for example. The printing unit 101 may include an image forming unit 20, which may include a plurality of the photoconductor drums 40Y, 40M, 40C, and 40K for forming images of yellow (Y), magenta (M), cyan (C), and black (K), respectively. Hereinafter, Y, M, C, and K may represent yellow, cyan, magenta, and black, respectively. The image forming apparatus 100 uses the photoconductor drums 40Y, 40M, 40C, and 40K as image bearing members arranged in a tandem manner, in which the photoconductor drums 40Y, 40M, 40C, and 40K, having a same diameter, are aligned along a face of an intermediate transfer belt 10 with a same interval.

The image forming apparatus 100 includes a transfer belt unit including the intermediate transfer belt 10, and a support rollers 14, 15, and 16 extending the intermediate transfer belt 10. The support roller 15 is used as a drive roller 15, the support roller 13 is used as a first driven roller 14, and the support roller 16 is used as a second driven roller 16. The intermediate transfer belt 10 may travel in a clockwise direction shown by an arrow A1 in FIG. 5 by rotating the support rollers 14, 15, and 16 using a drive unit. A transfer belt cleaning unit 19, facing the intermediate transfer belt 10 and the support roller 15, cleans the intermediate transfer belt 10 after the toner image is transferred to the sheet.

The image forming unit 20 includes image forming engines 18Y, 18M, 18C, and 18K, arranged in tandem along a belt extended by the drive roller 15 and the first driven roller 14, for forming color images of yellow (Y), magenta (M), cyan (C), and black (K). The image forming engines 18Y, 18M, 18C, and 18K include the photoconductor drums 40Y, 40M, 40C, and 40K, respectively. An optical writing unit 21 is disposed over the image forming unit 20.

The image forming apparatus 100 further includes a secondary transfer unit 22 under the intermediate transfer belt 10. The secondary transfer unit 22 includes tension rollers 23 and a secondary transfer belt 24 extended by the tension rollers 23. The secondary transfer belt 24 is pressed toward the second driven roller 16 via the intermediate transfer belt 10. The secondary transfer unit 22 is used to transfer a toner image from the intermediate transfer belt 10 to a sheet. The secondary transfer belt 24 is used to transport the sheet having the toner image transferred from the intermediate transfer belt 10. The transfer belt cleaning unit 19, facing the intermediate transfer belt 10, cleans the intermediate transfer belt 10 after the toner image is transferred to the sheet.

The image forming apparatus 100 further includes a fixing unit 25 next to the secondary transfer unit 22 to fix the toner image on the sheet, transported from the secondary transfer unit 22. The fixing unit 25 includes a fixing belt 26 and a pressure roller 27 pressed against the fixing belt 26. In another configuration, the secondary transfer unit 22 may be composed of a transfer roller or a non-contact type charger without providing a sheet transport function.

The image forming apparatus 100 further includes a sheet reverse unit 28 under the secondary transfer unit 22 and the fixing unit 25. The sheet reverse unit 28 reverses the faces of sheet so as to record images on both face of the sheet.

When a copying operation is performed by the image forming apparatus 100, a document is set on the document tray 30 of the ADF 250, or a document is set on a contact glass 32 by pivoting the ADF 250 upward and then closing the ADF 250 after setting the document on the contact glass 32. Then a start button in an operation panel is pressed for starting a copying operation. When the document is set on the ADF 250, the document is sent to the contact glass 32 by pressing the start button from the ADF 250, and then is scanned by the scanner 200 to generate image data. When the document is set on the contact glass 32, the document is scanned by the scanner 200 by pressing the start button to generate image data.

The scanner 300 includes a first carriage 33 and a second carriage 34, which can move when scanning a document. A light source of the first carriage 33 emits light to the document placed on the contact glass 32, and then a first reflector reflects the light reflected from the document to a second reflector of the second carriage 34. Then the light is reflected by the second reflector and guided to a focus lens 35. The focus lens 35 focuses the light coming from the second carriage 34 to the image sensor 36, which reads image data of the document.

While scanning the document, the support roller 15 is rotated by a drive motor 17 (see FIG. 6) to rotate the intermediate transfer belt 10 in a clockwise direction, by which the first driven roller 14 and the second driven roller 16 also rotate. Further, in each of the image forming engines 18, latent images of yellow, magenta, cyan, black are formed on the rotating photoconductor drums 40Y, 40M, 40C, and 40K, and the latent images are developed as toner images of each color. The toner images are then superimposingly transferred from the photoconductor drums 40Y, 40M, 40C, and 40K onto the intermediate transfer belt 10 to form a full-color image on the intermediate transfer belt 10.

While forming the toner images as such, a feed roller 42 of the sheet feed unit 150 rotates to feed a sheet to a sheet route 46 from one of sheet cassettes 44 provided in a sheet bank 43, in which a separation roller 45 separates sheets one by one. A transport roller 47 transports the sheet to registration roller(s) 49 via a feed route 48 in the image forming apparatus 100. The registration roller 49 stops a sheet transported from the sheet feed unit 150; or a sheet is fed from a manual tray 51 by rotating a feed roller 50 and separating the sheet one by one by a separation roller 52 to a manual feed route 53, and then transported to the registration roller 49, which stops the sheet.

The registration roller 49 rotates to feed the sheet to a transfer nip between the intermediate transfer belt 10 and the secondary transfer unit 22 at a time that the toner images on the intermediate transfer belt 10 comes to the transfer nip facing the secondary transfer unit 22, by which a color image can be transferred onto the sheet by the secondary transfer unit 22.

The sheet having the toner images is then transported to the fixing unit 25 by the secondary transfer belt 24, at which the toner images are fixed on the sheet by applying heat and pressure to the sheet, by which a color image is formed on the sheet.

After passing the fixing unit 25, by adjusting a position of a switch claw 55, the sheet may be stacked on an ejection tray 57 by using an ejection roller 56, or may be sent to the sheet reverse unit 28 for double face printing, in which after fixing another image on the other face of the sheet, the sheet may be stacked on the ejection tray 57 by using the ejection roller 56.

After a transfer process at the secondary transfer unit 22, the transfer belt cleaning unit 19 removes residual materials, such as toner, remaining on the intermediate transfer belt 10 to prepare the intermediate transfer belt 10 for an next image forming process. The registration roller 49 may be typically earthed, but the registration roller 49 can be applied with a bias voltage to remove paper powders.

When a black image forming is conducted, the photoconductor drums 40Y, 40M, and 40C are separated from the intermediate transfer belt 10. For example, a separation unit can pivot the transfer belt unit in a counter-clockwise direction in FIG. 5, by which the photoconductor drums 40Y, 40M, and 40C can be separated from the intermediate transfer belt 10 while the photoconductor drum 40K is still contacted to the intermediate transfer belt 10.

A description is now given to a method of controlling a driving of the intermediate transfer belt 10 according to a first exemplary embodiment.

In the image forming apparatus 100, a belt moving velocity of the intermediate transfer belt 10 is ideally set to a constant velocity. However, the belt moving velocity may vary or fluctuate because the intermediate transfer belt 10 has some variation in its belt thickness. If toner images are transferred from the photoconductor drums 40Y, 40M, and 40C to the intermediate transfer belt 10 moving at such varied belt moving velocity, color-to-color displacement may occur on a superimposed color image composed of four color images because each of the toner images may not be transferred on a same transfer position (i.e., deviation of a transfer position).

If the belt moving velocity of the intermediate transfer belt 10 becomes faster than a normal velocity, an image transferred at such a time may become an extended image compared to an intended image shape in a direction of belt moving direction, by which such image has a light-concentration image (less image concentration).

On the contrary, if the belt moving velocity of the intermediate transfer belt 10 becomes slower than a normal velocity, an image transferred at such a time may become a shrunken image compared to an intended image shape in a direction of belt moving direction, by which such image has a thick-concentration image (greater image concentration).

As a result, an image formed on a sheet may have image concentration variation (i.e., banding phenomenon) periodically, cyclically, or at regular intervals in a direction corresponding to the belt moving direction of the intermediate transfer belt 10.

Hereinafter, a configuration and operation for keeping the belt moving velocity of the intermediate transfer belt 10 at a constant velocity with high precision according to a first exemplary embodiment is explained. The following description is not limited to the intermediate transfer belt 10, but can be similarly used to other belts, which require a drive control. The intermediate transfer belt 10 may be referred as the transfer belt 10 hereinafter.

Figure 6:
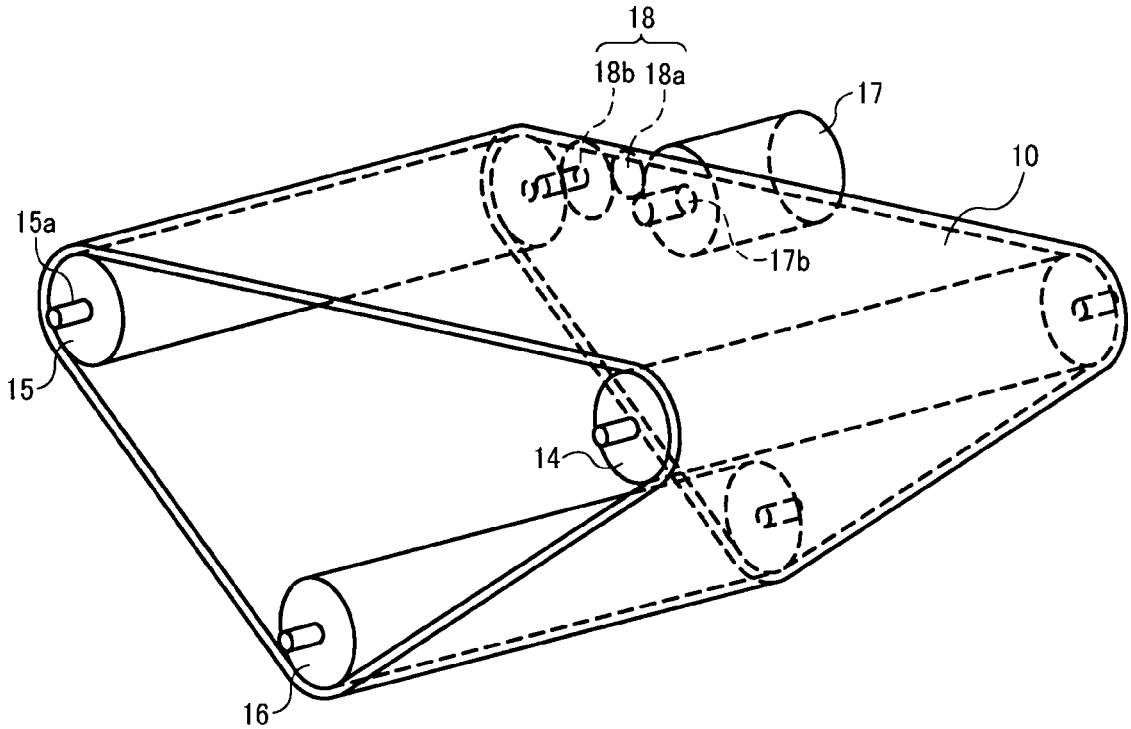
FIG. 6 illustrates a perspective view of a transfer belt used in the image forming apparatus of FIG. 5.

FIG. 6 illustrates a schematic perspective view of the transfer belt 10 and a driving mechanism of the transfer belt 10. The drive roller 15 is driven by a drive motor 17 (i.e., a drive source) via a transmission mechanism 18. The drive motor 17 includes an output shaft 17*b*. The transmission mechanism 18 includes a first rotating device 18*a* and a second rotating device 18*b*. The first rotating device 18*a* contacts the output shaft 17*b*, and the second rotating device 18*b*. The second rotating device 18*b* contacts a drive shaft 15*a* of the drive roller 15.

Accordingly, The drive roller 15 is transmitted a rotational driving force from the drive motor 17 via the transmission mechanism 18. Specifically, the rotational driving force of the drive motor 17 is transmitted to the first rotating device 18*a* via the output shaft 17*b*. The rotational driving force is then transmitted to the second rotating device 18*b* from the first rotating device 18*a*. The rotational driving force is then transmitted to the drive shaft 15*a* of the drive roller 15 to rotate the drive roller 15.

Accordingly, the drive roller 15 can be rotated at a speed which is proportional to a drive speed of the drive motor 17. When the drive roller 15 rotates, the transfer belt 10 is rotated and then the first driven roller 14 is rotated.

The first driven roller 14 is provided with a rotary encoder to detect an angular velocity (or rotation angle displacement) of the first driven roller 14. As such, the rotary encoder is used to detect an angular velocity of the first driven roller 14. Based on a detection result of the first driven roller 14, the speed of the drive motor 17 can be controlled by following computation. The term of angular velocity or rotation angle displacement of the roller are used for a similar meaning.

In an exemplary embodiment, a target rotation speed of the drive roller 15 is set in advance and a PLL control is conducted, by which a rotation speed of the drive roller 15 detected by an encoder may be kept at the target rotation speed. In such PLL control, a control gain is applied to conduct a driving control for the transfer belt 10 in view of a speed fluctuation in the transfer belt 10. With such control, a speed fluctuation in the transfer belt 10 can be reduced, and color-to-color displacement can be prevented.

However, when a control gain is applied for PLL control using the encoder to control a drive speed of the drive motor 17, a thickness fluctuation in the transfer belt 10 may cause and increase detection error, and the drive motor 17 may be driven based on such increased detection error. Therefore, a thickness fluctuation in the transfer belt 10 causes a speed fluctuation in the transfer belt 10, by which color-to-color displacement may occur.

Figure 7:
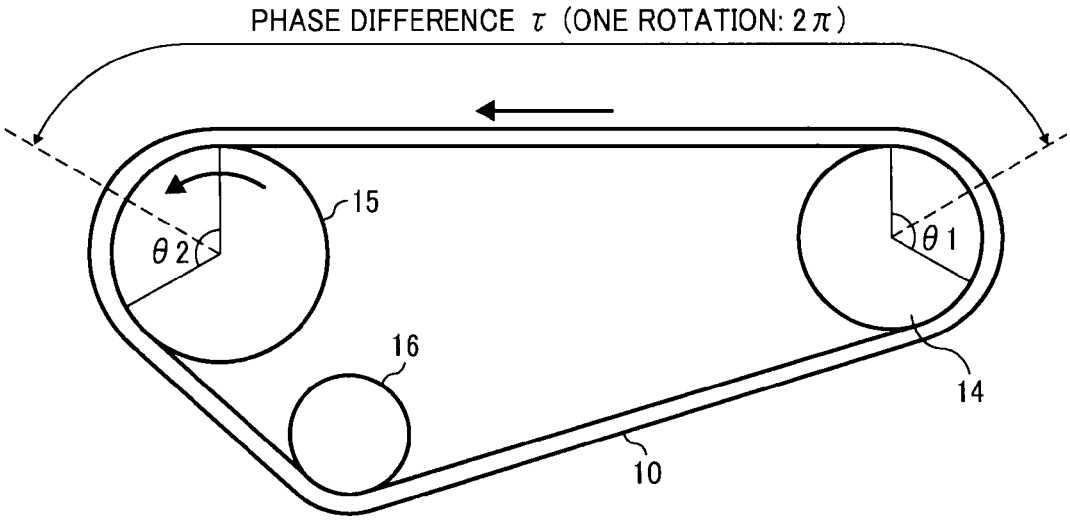
FIG. 7 illustrates a configuration of the transfer belt of FIG. 6.

FIG. 7 illustrates a schematic cross-sectional view of the transfer belt 10. The transfer belt 10 is extended by the first driven roller 14 and the drive roller 15. The transfer belt 10 endlessly moves in a direction shown by an arrow A1 in FIG. 7. The driven roller 14 is wound with the transfer belt 10 with a belt winding angle θ1, and the drive roller 15 is wound with the transfer belt 10 with a belt winding angle θ2 as shown in FIG. 7. As understood from the equation (1), even if the drive motor 17 (FIG. 6) is rotated at a constant speed and the transfer belt 10 moves without a speed variation or fluctuation, following phenomenon occurs.

In one case, if a thicker part of the transfer belt 10 winds around the first driven roller 14, an effective radius of the transfer belt 10 (see FIG. 7) at the first driven roller 14 becomes greater, by which the angular velocity of the driven roller 14 per unit time decreases, and such decrease is detected as a decrease of the transport speed of the transfer belt 10.

In another case, if a thinner part of the transfer belt 10 winds around the first driven roller 14, an effective radius of the endless belt at the first driven roller 14 (see FIG. 7) becomes smaller, by which the angular velocity of the driven roller per unit time increases, and such increase is detected as an increase of the transport speed of the transfer belt 10.

Figure 8:
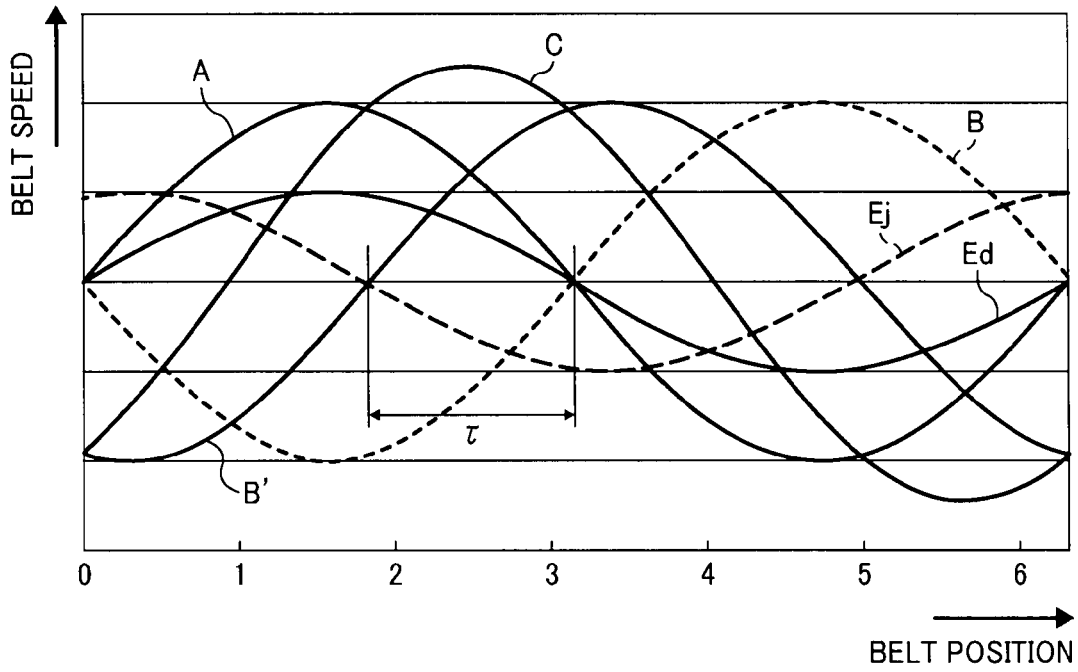
FIG. 8 shows profiles of belt speed of the transfer belt relative to the transfer belt position.

A description is now given to a case that a moving velocity of the transfer belt 10 is set to a constant level by varying an angular velocity of the drive roller 15 with reference to FIG. 8.

Profile A shows the belt moving velocity of the transfer belt 10 when the drive roller 15 rotates at a constant angular velocity.

Profile B shows the angular velocity of the drive roller 15 when transfer belt 10 rotates at a constant velocity. The profile B is shifted from the profile A for a phase of "n".

Profile C shows the angular velocity of the first driven roller 14 when the drive roller 15 rotates at a constant angular velocity.

Profile B' shows the angular velocity of the first driven roller 14 when the transfer belt 10 rotates at a constant belt moving velocity.

Profile Ej shows variation of the effective belt thickness at the first driven roller 14 shown in FIG. 7.

Profile Ed shows variation of the effective belt thickness at the drive roller 15 shown in FIG. 7.

As shown in FIG. 8, the profile C which shows the angular velocity of the first driven roller 14 when the drive roller 15 rotates at a constant angular velocity can be formed by superimposing the profile A and the profile B'. The profile A shows a belt moving velocity of the transfer belt 10 when the drive roller 15 rotates at a constant angular velocity. The profile B' shows an angular velocity of the driven roller 14 when the transfer belt 10 rotates at a constant belt moving velocity.

Further, the profile B shows the angular velocity of the drive roller 15 when transfer belt 10 is assumed to rotate at a constant velocity. The profile B is shifted from the profile A for a phase of "π". Under such condition, the angular velocity of the first driven roller 14 takes the profile B' shown in FIG. 8. Then, a difference between the angular velocity of the drive roller 15 (the profile B shifted from the profile A for "n") and the angular velocity of the first driven roller 14 (the profile B') becomes the profile C (the angular velocity of the first driven roller 14 when the drive roller 15 rotates at a constant angular velocity).

In the above case, the transfer belt 10 is assumed to be rotated at a constant moving velocity. In such case, when the angular velocity of the first driven roller 14 is subtracted from the angular velocity of the drive roller 15, the profile C (the angular velocity of the first driven roller 14 when the drive roller 15 rotates at a constant angular velocity) can be obtained. Therefore, even if angular velocity of the drive roller may fluctuate, by subtracting the angular velocity of the driven roller (driven roller shaft) from the angular velocity of the drive roller (drive roller shaft), a fluctuation component of belt caused by the thickness fluctuation in the transfer belt 10 can be obtained as similar to a case that the drive roller is rotated at a constant velocity. The term of angular velocity or rotation angle displacement of the roller are used for a similar meaning.

As above described, based on measurement data of the angular velocity variation of the driven roller 14 and the angular velocity variation of the drive roller 15, the angular velocity variation of the driven roller 14 caused by the thickness fluctuation in the transfer belt 10 can be computed. Based on such computed data, a target value for controlling the driven roller 14 is set, wherein the transfer belt 10 can be rotated at a constant transport speed under such target value of the driven roller 14. Then, such target value and an output value of an encoder disposed at the driven roller 14 are compared each other to control a driving of the transfer belt 10.

In such method, a thickness (e.g., μm) of the transfer belt 10 is not measured actually but a variation of angular velocity (e.g., radian) of the first driven roller 14 caused by a thickness fluctuation in the transfer belt 10 can be detected by the encoder, and such detected angular velocity can be used as a control parameter for controlling a driving of the transfer belt 10. Because the control parameter can be generated using the angular velocity of the first driven roller 14 and the output value of the encoder, the control parameter for an actual apparatus can be generated without measuring an actual thickness of the transfer belt 10. Accordingly, a specific measurement device for measuring the thickness of the transfer belt 10 may not be required, by which an image forming apparatus can be manufactured with a less expensive cost.

Actual output result of the encoder may include the variation of the angular velocity of the first driven roller 14 caused by the thickness fluctuation in the transfer belt 10 and other components such as fluctuation in angular velocity and eccentricity of the drive roller 15 and other devices. Accordingly, an extraction process is conducted to extract the component other than the component for the first driven roller 14. Based on such extracted result, a control parameter for angular velocity of the first driven roller 14 can be obtained.

The rotary encoder can be disposed to any one of the first driven roller 14 and the second driven roller 16. Further, the rotary encoder can be disposed to any one of rollers extending the transfer belt 10 except the drive roller 15.

Figure 9:
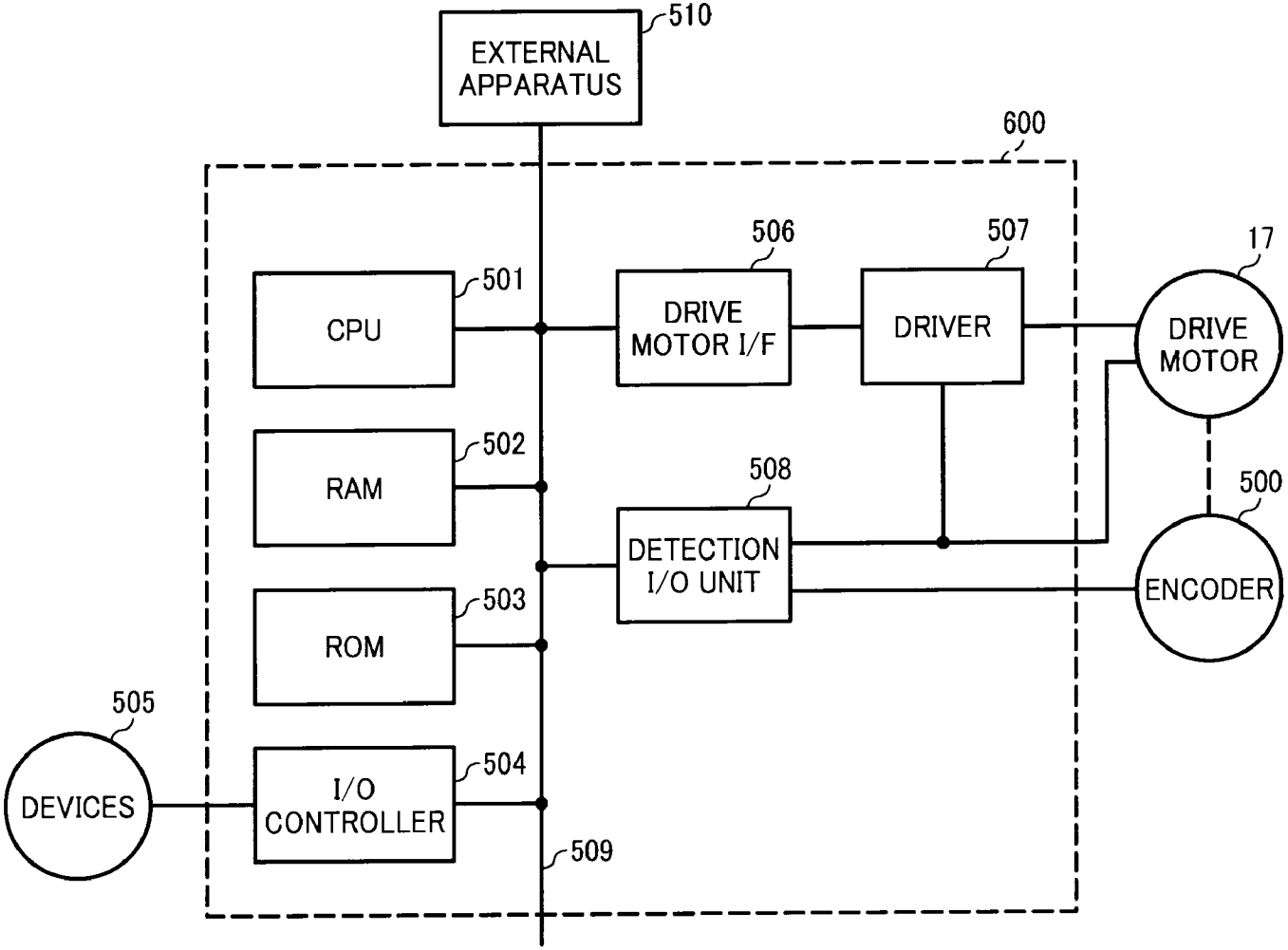
FIG. 9 illustrates a block diagram of a hardware configuration used for controlling a drive motor.

FIG. 9 shows a block diagram of a hardware configuration for a belt drive control unit 600 for controlling the drive motor 17. The control system is used to digitally control a drive pulse for driving the drive motor 17 based on a pulse signal output from an encoder 500 (see FIG. 10) disposed for the first driven roller 14. The belt drive control unit 600 includes a CPU (central processing unit) 501, a RAM (random access memory) 502, a ROM (read only memory) 503, an I/O (input/output) controller 504, a drive motor I/F (interface) 506, a driver 507, and a detection I/O (input/output) unit 508, for example.

The CPU 501 controls operations to be conducted in the image forming apparatus 100, such as for example receiving image data from an external apparatus 510, and transmission of control commands.

The RAM 502 used as a working memory and the ROM 503 used for storing software programs, and the I/O controller 504 are connected each other via a bus 509. The CPU 501 instructs operations, such as data reading/writing process, or activation of motor/clutch/solenoid/sensor to drive devices 505, which is activated by inputting some load.

Under an instruction of the CPU 501, the drive motor I/F 506 transmits a command signal for commanding a drive frequency of drive pulse to the driver 507. Using such drive frequency, the driver 507 conducts a PLL control, by which the drive motor 17 is rotated.

The pulse signal output from the encoder 500 and frequency generator (FG) signal (hereinafter, referred as "FG pulse" or "motor FG pulse") for the drive motor 17 are input to the detection I/O unit 508. The detection I/O unit 508 processes the pulse signal output from the encoder 500 and the FG pulse from the drive motor 17, and converts them in digital data. The detection I/O unit 508 has a counter to count the number of output pulse signals. The number of output pulse signals, counted by the counter, is transmitted to the CPU 501 via the bus 509.

The drive motor I/F 506 generates a control signal (e.g., pulse signal) based on a command signal (for drive frequency) transmitted from the CPU 501.

The driver 507 may include an integrated chip for PLL control and a power semiconductor (e.g., transistor). Based on the control signal transmitted from the drive motor I/F 506 and pulse signals of the encoder 500 (disposed near the first driven roller 14), the driver 507 conducts PLL control so that an angular velocity of the first driven roller 14 can be set to have a same speed and a same phase of the control signals.

Further, a phase signal, corresponding to pulse frequency generated by PLL control, is applied to the drive motor 17. As a result, the first driven roller 14 can be driven at a given drive frequency output from the CPU 501. Then, the first driven roller 14 can be rotated at a given angular velocity at a constant angular velocity, by which a disk included in the encoder 500 can be rotated at a target angular velocity.

The information of angular velocity of the disk, detected by the encoder 500 and the detection (input/output) I/O unit 508, is then transmitted to the CPU 501 to repeat a control process.

The RAM 502 may be used for several purposes; the RAM 502 may be used as a working area to execute programs stored in the ROM 503; the RAM 502 may be used as a data storage area for low-pass filter which removes noise from the difference value between the pulse signal of the encoder 500 and the motor FG pulse of the drive motor 17; the RAM 502 may be used as a data storage area for data thinning process; the RAM 502 may be used as a data storage area for storing correction value.

The RAM 502 may be a volatile memory. Accordingly, parameters such as amplitude/phase value to be used for the next driving control of the transfer belt 10 may be stored in a non-volatile memory such as EEPROM (electrically erasable programmable read only memory). Such parameters for one rotation of the transfer belt 10 may be set in the RAM 502 using sin function or an approximate expression when a power is set to ON or when the drive motor 17 is activated.

Although actual thickness fluctuation in the transfer belt 10 may be influenced by a manufacturing process, most of thickness fluctuation in the transfer belt 10 may become like a sinusoidal. Accordingly, error data of detected angular velocity of the roller for one rotation of the transfer belt 10 may not need to be retained in a non-volatile memory.

For example, during a measurement process of the transfer belt 10, data of phase and amplitude relative to a reference position can be computed, and such computed data can be used to compute deviation data of detected angular velocity caused by a thickness fluctuation in the transfer belt 10. Such deviation data can be effectively used. Accordingly, the deviation data for belt drive control for each rotation may not need to be stored in a non-volatile memory, and the deviation data can be generated using the computed phase and amplitude, by which a volatile memory alone may sufficient for the belt drive control. Such deviation data may be generated when a power is set to ON or when the drive motor 17 is activated, for example.

Figure 10:
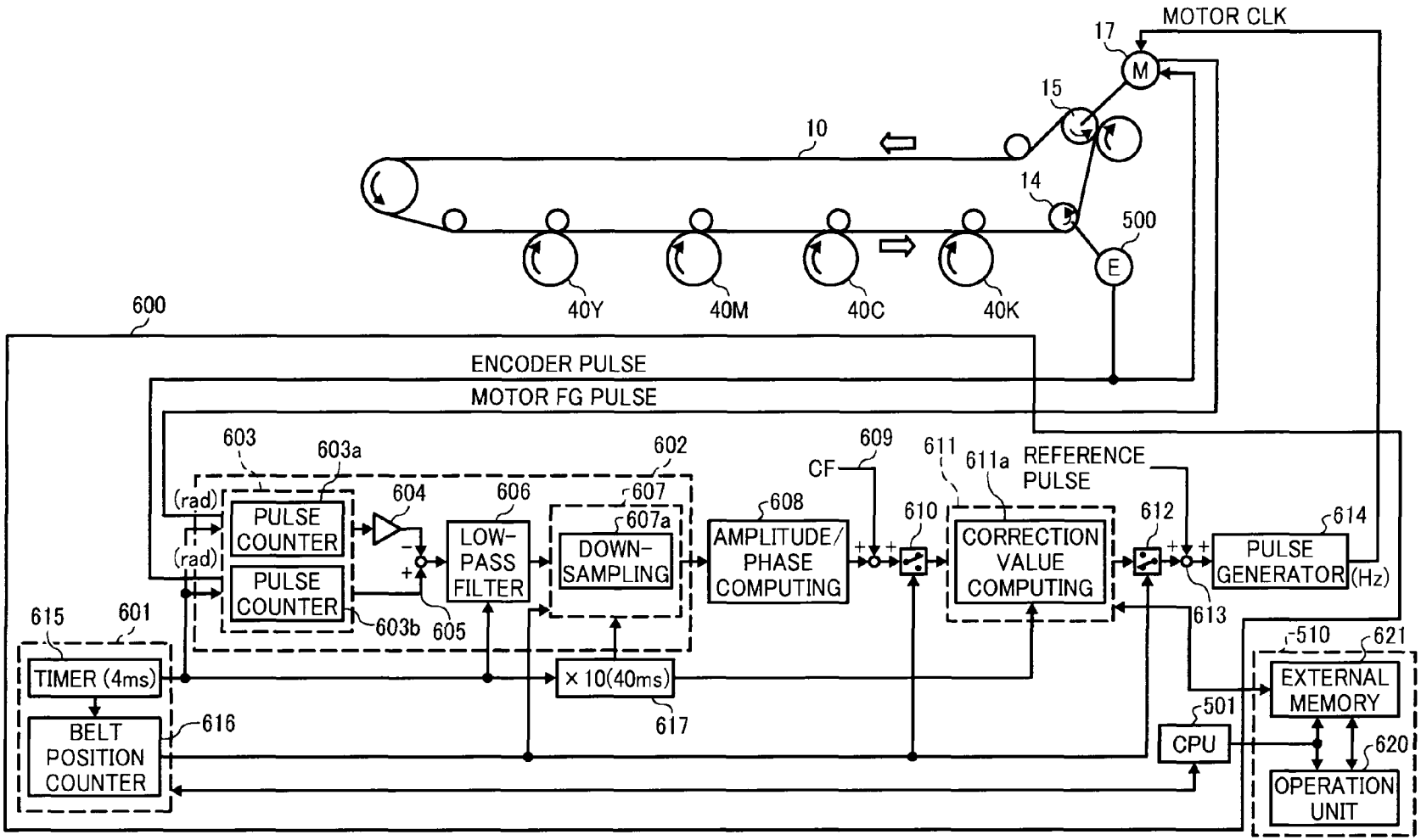
FIG. 10 illustrates a block diagram of a belt-drive control system according to a first exemplary embodiment.

FIG. 10 shows a block diagram of a belt drive control unit 600, according to a first exemplary embodiment, for controlling a driving of the transfer belt 10.

In such a configuration shown in FIG. 10, the angular velocity of the drive motor 17 and the angular velocity of the first driven roller 14 detected by the encoder 500 are input to the belt drive control unit 600. Specifically, the first driven roller 14 is provided with the encoder 500. The drive motor 17 may be a DC (direct current) brushless motor. The angular velocity of the drive motor 17 is counted by using FG pulse. The FG pulse corresponds to a rotation speed of a rotor in the drive motor 17. In stead of the FG pulse, the drive motor 17 may be disposed of an encoder at its shaft, by which the angular velocity of the drive motor 17 can be detected using pulse signal generated by the encoder.

The belt drive control unit 600 includes a pulse counter unit 603, a constant unit 604, a subtraction unit 605, a low-pass filter 606, a downsampling processing unit 607, a amplitude/phase computing unit 608, a correction factor computing unit 609, a correction value storage control unit 610, a correction value computing unit 611, a correction value reading control unit 612, a reference pulse supply unit 613, a pulse generator 614, and a count generation unit 601.

The pulse counter unit 603 includes pulse counters 603*a*/603*b* to count pulse numbers of the angular velocity of the drive motor 17 and the angular velocity of the first driven roller 14 detected by the encoder 500, respectively.

The constant unit 604 converts count number of the FG pulses of the drive motor 17 so that the converted count number can be compared with the count number of pulse signals of the encoder 500.

The subtraction unit 605 computes the difference of the count number of the FG pulses and pulse signals of the encoder 500.

The low-pass filter 606 removes high-frequency noise.

The downsampling processing unit 607 includes a memory 607*a*. The downsampling processing unit 607 conducts downsampling process for the subtraction results transmitted from the low-pass filter 606 and stores downsampling results for one rotation of the transfer belt 10 to the memory 607*a*.

As shown in FIG. 10, the pulse counter unit 603 to the downsampling processing unit 607 may be collectively referred as a sampling data acquisition unit 602.

The amplitude/phase computing unit 608 extracts thickness fluctuation in the transfer belt 10 from the downsampling results for one rotation of the transfer belt 10.

The correction factor computing unit 609 provides a correction factor "CF" to the amplitude/phase value.

The correction value storage control unit 610 includes a memory 611*a*. The correction value storage control unit 610 controls an operation of storing the computed amplitude/phase value as correction value data to the memory 611*a* provided in the correction value computing unit 611.

The correction value computing unit 611 computes correction value data based on the computed amplitude/phase value and prepares a data table.

The correction value reading control unit 612 controls an operation of reading the correction value data stored in the memory 611*a*. The computed correction value data may be corresponded to each rotation number or period of the transfer belt 10.

The reference pulse supply unit 613 supplies a reference pulse "RP" to the correction value data read by the correction value computing unit 611.

The pulse generator 614 generates pulse signal to be supplied to the drive motor 17 using the reference pulse.

The count generation unit 601 includes a timer 615 and a belt position counter 616. The timer 615 may be 4-ms (milliseconds) timer. The belt position counter 616 detects a relative position of the transfer belt 10 rotating in one direction.

The CPU 501 sets a condition to the count generation unit 601 to control the timer 615 and the belt position counter 616.

In the sampling data acquisition unit 602, the pulse counter unit 603 counts pulse numbers of the angular velocity of the drive motor 17 and the angular velocity of the first driven roller 14 detected by the encoder 500.

The counting of pulse signals is conducted using a hardware, in which an edge of pulse is detected to measure the number of input of edges of pulse signals. Because resolution of pulse signals is different between the motor FG pulse of the drive motor 17 and the pulse signals of the encoder 500, the constant unit 604 applies a constant K1 to the motor FG pulse to set a same resolution for the motor FG pulse and the pulse signals of the encoder 500. Then, a difference value between the pulses can be computed using the counted pulse numbers. In the first exemplary embodiment, the belt drive control unit 600 includes the timer 615, which is a 4-ms timer. Accordingly, the pulse counter number can be checked every 4-ms timing. The computed difference value is then stored in a memory in the low-pass filter 606 with 4-ms cycle.

Although configurations of the transfer belt 10 and photoconductor drum 40 are different between FIG. 10 and FIG. 5, such difference does not affect features for the present invention, which is explained as exemplary embodiments. Such difference is within design variation of image forming apparatus.

Further, the computing timing of difference value is not limited to 4-ms, but other timing can be set. For example, high-speed sampling having a shorter sampling timing can be set to reduce quantization error on sampling. The sampling timing can be determined by a pulse generation cycle, which may be determined by the resolution of the motor FG pulse of the drive motor 17/pulse signal of the encoder 500 and a rotation speed of the transfer belt 10, and a storage capacity of an internal memory.

The motor FG pulse of the drive motor 17 and the pulse signal of the encoder 500 may include several periodical fluctuation components (e.g., periodical fluctuation in a rotating roller, periodical fluctuation in a drive gear, thickness fluctuation in the transfer belt 10). Therefore, the low-pass filter 606 is used to remove periodical fluctuation components except thickness fluctuation in the transfer belt 10 by conducting a moving average process for the computed difference value, obtained based on the 4-ms cycle sampling.

In exemplary embodiments, to remove the periodical fluctuation component of the drive roller 15, which is relatively close to the periodical fluctuation component of the transfer belt 10, a moving average process is conducted using a memory, which can store difference values for two rotations of the drive roller 15. Such removal process is conducted in advance because a computation error may occur when computing amplitude/phase value (to be described later) if a periodical fluctuation component closer to the periodical fluctuation component of the transfer belt 10 is superimposed to the periodical fluctuation component of the transfer belt 10.

After the moving average process for data, the data receives a data thinning process by a position counter 617 having a 40-ms cycle for downsampling. Specifically, the data for one rotation of the transfer belt 10 receives a data thinning process by the position counter 617 every 40 ms, which is ten times of 4 ms, and then the data for one rotation of the transfer belt 10 is stored in the memory 607*a* in the downsampling processing unit 607. Such data thinning process may be referred as downsampling processing.

A sampling thinning cycle of data may be determined as follows: in the moving average process, sampling of data is conducted in a relatively short cycle (e.g., 4 ms) to reduce quantization error on sampling; when computing amplitude/phase value for one rotation of the transfer belt 10 by the amplitude/phase computing unit 608, the number of data may not need be so large if such data do not include other fluctuation component. Accordingly, in exemplary embodiments, after the moving average process, the data may receives the data thinning process using 40-ms cycle and stored in the memory.

To compute a phase value by using the amplitude/phase computing unit 608, a reference position on the transfer belt 10 needs to be checked and controlled. Specifically, the transfer belt 10 is put with a reference position mark on its face, and a sensor is used to detect the reference position of the transfer belt 10, by which the reference position of the transfer belt 10 during data sampling can be checked. The pulse count number can be checked using the 4-ms timer, and a timing, which starts a computation of difference value, can be counted from a virtual reference position of the transfer belt 10. Hereinafter, such virtual reference position is referred as a "virtual home position VHP" of the transfer belt 10. Accordingly, data for the transfer belt 10 rotating at a given speed is counted with 4 ms-interval for each of the rotation of the transfer belt 10 using the "virtual home position VHP" as a reference position. Further, a data writing (storing)/reading timing for the memory 608*a* in the downsampling processing unit 608 can be controlled using the virtual home position VHP as a reference position.

For example, the virtual home position VHP of the transfer belt 10 may be determined as below. If a phase difference "τ" for one rotation of the transfer belt 10 is set to "2π" as shown in FIG. 7, an accumulated rotation angle of the drive roller 15, an accumulated rotation angle of the encoder 500 disposed near the first driven roller 14, and a signal generated based on a 4-ms cycle clock signal of the timer 615 may be used to compute one rotation of the transfer belt 10 to compute the virtual home position VHP of the transfer belt 10.

After storing data of the transfer belt 10 for one rotation in the memory of the downsampling processing unit 607, the amplitude/phase computing unit 608 computes a phase value and a maximum amplitude value at the reference position VHP. The amplitude/phase value can be computed using higher-order component of periodical fluctuation component of the transfer belt 10. For example, in an exemplary embodiment, the amplitude/phase value is computed using first, second, and third-order component.

After the data thinning process, the data receives a quadrature detection process to compute the amplitude/phase value. The quadrature detection process can be typically conducted as below. If one profile of wave pattern change periodically in a given cycle time T, following equations (2a) and (2b) can be set.

$$\text{Fundamental frequency: } f0=1/T \tag{2a}$$

$$\text{Base angular frequency: } \omega 0=2\pi f0 \tag{2b}$$

Discrete data can be expressed by the equation (3) using Fourier series.

$$\begin{aligned} x(t) &= a_0 + a_1\cos\omega_0 t + \ldots + a_n\cos n\omega_0 t + \\ &\quad b_1\sin\omega_0 t + \ldots + b_n\sin n\omega_0 t \\ &= a_0 + \sum_{n=1}^{\infty}(a_0\cos n\omega_0 t + b_n\sin n\omega_0 t) \end{aligned} \tag{3}$$

$$(n = 1, 2, 3, \ldots, \infty)$$

The following equations (4a), (4b), and (4c) can be used to compute each component.

$$a_0 = \frac{1}{T}\int_0^T x(t)\,dt \tag{4a}$$

$$a_n = \frac{2}{T}\int_0^T x(t)\cos n\,\omega_0 t\,dt \tag{4b}$$

-continued $$b_n = \frac{2}{T}\int_0^T x(t)\sin n\omega_0 t\,dt \tag{4c}$$

In the equations (4a) to (4c), "a0" represents continuous component, "an" and "bn" respectively represent amplitude of cosine wave and sine wave having an angular frequency of "nω0". Accordingly, the following equations (5a) to (5c) can be obtained.

$$x(t) = \sum_{n=1}^{\infty} r_n\cos(n\omega_0 t - \Phi_n) \tag{5a}$$

$$r_n = \sqrt{a_n^2 + b_n^2} \tag{5b}$$

$$\Phi_n = \tan^{-1}\frac{b_n}{a_n} \tag{5c}$$

In the equations (5a) to (5c), "rn" and "pn" respectively represent amplitude and phase for the n-th order higher harmonic wave. The computation of amplitude and phase value may be conducted as below: First, discrete data processed by the data thinning process and stored in the memory of the downsampling processing unit 607 are input to the equations (4a) to (4c), and frequency "f" of one rotation of the transfer belt 10 and data sampling time "t" for discrete data during a measurement process are used, and sine and cosine operation is computed. Based on the accumulated value of sine and cosine operation, "an" and "bn" are computed. Then, using the equations (5a) to (5c), "rn" and "ϕn" are computed. In exemplary embodiments, such computing process may be conducted for three times because amplitude/phase needs to be computed for first to third components, for example.

Further, the above described computed results may include a detection error of the drive roller 15 and a detection error of the first driven roller 14. Accordingly, the amplitude value may be corrected using a conversion factor, which can be determined by a mechanical layout of a transfer unit. By using such conversion factor, a detection error of the first driven roller 14 can be computed.

After computing the amplitude/phase value for the first to third components, which may be erroneously detected at the driven roller 14, a composite waveform having each of the components is computed using a sine function, and the correction value computing unit 611 computes a correction table for per one rotation of the transfer belt 10. As similar to the downsampling processing unit 607, the correction value computing unit 611 includes the memory 611*a*, to which data writing and reading for one rotation of the transfer belt 10 is conducted.

After computing the correction value data using the correction value computing unit 611, the pulse generator 614 generates a pulse signal to be output to the drive motor 17. When generating the pulse signal, data for corresponding each of rotation numbers of the transfer belt 10 is read from the memory 611*a* of the correction value computing unit 611.

The value computed by the correction value computing unit 611 is based on the difference value between the motor FG pulse of the drive motor 17 and the pulse signal of the encoder 500 measured in 4-ms cycle. By converting the computed value computed by the correction value computing unit 611 into a frequency and adding the frequency to an original reference frequency, a frequency to be supplied to the drive motor 17 is determined. Based on such frequency, a pulse signal to be supplied to the drive motor 17 can be generated.

The above-described processes are repeated for each of the rotation of the transfer belt 10 to control the moving velocity of the transfer belt 10 at a constant level. As above described, the above-described processes includes measurement of the motor FG pulse of the drive motor 17 and the pulse signal of the encoder 500; extraction of detection error of the first driven roller 14 due to thickness fluctuation in the transfer belt 10; setting a target frequency based on the detection error; and driving the drive roller 17 using PLL control.

A description is now given to a method of controlling a driving of the transfer belt 10 using the belt drive control unit 600 according to the first exemplary embodiment.

As shown in FIG. 10, the CPU 501 is provided in the belt drive control unit 600 of the image forming apparatus 100. When the CPU 501 instructs a driving request to the drive motor 17, the drive motor 17 starts to rotate, by which the transfer belt 10 can be rotated. The CPU 501 waits for some time until the transfer belt 10 can rotate at a stable condition. When such stable rotation of the transfer belt 10 is established, the CPU 501 instructs the pulse counter unit 603 to count the motor FG pulse of the drive motor 17 and the pulse signal of the encoder 500. Then the subtraction unit 605 subtracts the counted results to compute thickness fluctuation in the transfer belt 10. The CPU 501 also controls the correction value storage control unit 610, and the correction value reading control unit 612, in which data storing and reading for each of the rotation numbers of the transfer belt 10 and the count number of timer are conducted to the relevant memory.

For the simplicity of explanation of data storing and reading timing to each of the memories, a simple sine wave is used for the thickness fluctuation in the transfer belt 10.

A description is now given to a method of belt drive control according to the first exemplary embodiment with reference to FIG. 11. FIG. 11 shows data storing and reading timing to memories set in a down-sampling area of the downsampling processing unit 607 and a correction value area of the correction value computing unit 611.

A timer-count number "n" ("n" is zero or positive integer) indicates a count number counted by the timer 615 with 4-ms cycle. In the first exemplary embodiment, the timer-count number "n" becomes 2020 counts for one rotation of the transfer belt 10, for example. Further, the belt rotation number "m" indicates the number of actual rotation of the transfer belt 10, in which "m" is zero or positive integer. Therefore, when the timer-count number "n" becomes 2020 counts, the belt rotation number "m" is counted for "one." Based on the belt rotation number "m", it is determined whether the transfer belt 10 is in the even-number rotation stage or the odd-number rotation stage.

In the first exemplary embodiment, when the drive motor 17 is activated to start a rotation of the transfer belt 10, the belt rotation number "m" is set to "1." Accordingly, the transfer belt 10 rotates from the odd-number rotation stage. Therefore, when the belt rotation number "m" is odd number, the transfer belt 10 is in the odd-number rotation stage, and when the belt rotation number "m" is even number, the transfer belt 10 is in the even-number rotation stage.

In step S0: After a driving request of the transfer belt 10 is issued by the CPU 501 and before driving the transfer belt 10, a set value (herein after "SP value") stored in an external memory 621 (e.g., non-volatile memory) is read. An operation unit 620 may be used to set the value in the external memory 621.

In step S1: the SP value is then stored in the memory 611*a* of the correction value computing unit 611 using the correction value storage control unit 610. Steps S0 and S1 may be required because no computed result exists for the correction value when the transfer belt 10 rotated for the first time. Accordingly, a correction value (e.g., SP value) may need to be read from a data storage (e.g., external memory 621) storing the SP value in advance.

In step S2: The CPU 501 drives the drive motor 17 to rotate the transfer belt 10. A position of the transfer belt 10 when the transfer belt 10 starts to rotate is set as a virtual home position VHP of the transfer belt 10 (see dotted ellipse line in FIG. 11). A thickness profile related to a rotation of the transfer belt 10, rotating in one direction, is shown at the top of FIG. 11.

In step S3: During the first rotation of the transfer belt 10, the correction value reading control unit 612 sequentially reads data of correction value for the first rotation of the transfer belt 10 from the memory 611*a* of the correction value computing unit 611 with 40-ms cycle. Then, the pulse generator 614 generates and outputs a pulse signal to be supplied to the drive motor 17 (step S3*a*).

Simultaneously, the CPU 501 controls a counting process for the number of the pulse signal of the encoder 500 and the motor FG pulse of the drive motor 17, a computing of difference value of the pulses (i.e., between the pulse signal of the encoder 500 and the motor FG pulse of the drive motor 17), and a moving average process for the difference value of the pulses using a software installed in the belt drive control unit 600. Further, the downsampling processing unit 607 sequentially stores sampling data, which receives a data thinning process thinned by using 40-ms cycle, to the memory 607*a* corresponding to the down-sampling area of the downsampling processing unit 607 (step S3*b*).

When the timer-count number "n" counts 2021, the process goes to step S4. In step S4: when timer-count number "n" counts 2021, the belt rotation number "m" of the transfer belt 10 becomes "2" and the transfer belt 10 is shifted to a second rotation. Then, sampling data is sequentially read from the memory 607*a* (step S4*a*). Further, the amplitude/phase computing unit 608 computes amplitude value and phase value for the sampling data obtained during the first rotation of the transfer belt 10 to obtain correction value data. After the computation, the correction value storage control unit 610 sequentially stores the correction value data obtained by the computation to the memory 611*a* corresponding to the correction value area of the correction value computing unit 611 (step S4*b*).

In the first exemplary embodiment, correction value data sequentially read from the memory 611*a* of the correction value computing unit 611 with 40-ms cycle may have corresponding data address, in which a memory address corresponding to the virtual home position VHP of the transfer belt 10 is set to zero "0," for example.

When the timer-count number "n" counts 4041, the process goes to step S5. In step S5: when timer-count number "n" counts 4041, the belt rotation number "m" of the transfer belt 10 becomes "3" and the transfer belt 10 is shifted to a third rotation. Then, the downsampling processing unit 607 sequentially stores sampling data of the difference value, which receives a data thinning process thinned by using 40-ms cycle, to the memory 607*a* corresponding to the down-sampling area of the downsampling processing unit 607.

In step S6: the correction value reading control unit 612 sequentially reads correction value data for one rotation of the transfer belt 10 from the memory 611*a*, corresponding to the correction value area of the correction value computing unit 611, with 40-ms cycle. Then, the pulse generator 614 generates and outputs a pulse signal to be supplied to the drive motor 17.

In step S7: the amplitude/phase computing unit 608 sequentially reads sampling data from the memory 607*a*, corresponding to the down-sampling area, and then computes amplitude value and phase value for the sampling data obtained during the third rotation of the transfer belt 10 to obtain correction value data (step S7*a*). Because the drive motor 17 stops in the middle of the fourth rotation, the correction value data is obtained until the memory address becomes a given address (e.g., address "y"). After the computation, the correction value storage control unit 610 sequentially stores the correction value data obtained by the computation to the memory 611*a*, corresponding to the correction value area of the correction value computing unit 611 (step S7*b*).

In step S8: when the transfer belt 10 stops at the timer count number "x," the correction value reading control unit 612 sequentially reads correction value data for one rotation of the transfer belt 10 from the memory 611*a*, corresponding to the correction value area, with 40-ms cycle. Then, the CPU 501 stores the obtained correction value dart as "SP value" to the external memory 621 (non-volatile memory), connected to the operation unit 620. Such "SP value" can be used when the drive motor 17 is activated for the next time. In such process, correction value data may be computed for a belt-move length (see an arrow B in FIG. 11) in the fourth direction, and such correction value data may be applied for the belt-drive control. Accordingly, the data sampled and stored in the first rotation (see arrow C in FIG. 11) can be applied for the belt drive control in the third rotation (see arrow A in FIG. 11) as correction value data. Specifically, a data thinning process is conducted in the first rotation, a correction value process is conducted in the second rotation, and then correction value data can be applied for the belt drive control in the third rotation, for example.

When repeating the above process, the CPU 501 controls the correction value storage control unit 610, and the correction value reading control unit 612 for data storing and reading to the memory in the downsampling processing unit 607 and the correction value storage control unit 610. As above described, the downsampling processing unit 607 includes one memory, which may have a maximum address N−1 (N=0 or positive integer) that can store data for one rotation of the transfer belt 10, and the correction value storage control unit 610 includes one memory, which may have a maximum address N−1 (N=0 or positive integer) that can store data for one rotation of the transfer belt 10. With such configuration, data storing and reading can be alternately selected and conducted depending on the rotation number of the transfer belt 10. With such a configuration, a timing, which can apply the correction value data obtained from the sampled data, can be started when the transfer belt 10 rotates for two times (two rotations) from the virtual home position VHP of the transfer belt 10, and such correction operation can be conducted until the drive motor 17 stops. For example, as shown in FIG. 11, the sampling data read in the first rotation of the transfer belt 10 can be converted to the correction value data, and then the correction value data can be used to correct the rotation of the transfer belt 10 in the third rotation of the transfer belt 10.

The "N" can be defined: N=T/C, in which "T" is time for one rotation of the transfer belt 10, and "C" is access cycle of memory. For example, If T=8 seconds and C=40 ms (0.04 sec), N=8/0.04=200.

As such, the correction value data sequentially stored in the memory 611*a* (correction value area) can be read sequentially with 40-ms cycle, and a timing for applying the correction value data can be shifted by interposing a time corresponding to one rotation of the transfer belt 10 between data acquisition and correction value data application. Accordingly, the correction value data obtained at a specific portion of the transfer belt 10 can be applied to the same specific portion on the transfer belt 10. Accordingly, the timing for applying the correction value to the transfer belt 10 may not be deviated from the specific portion, which may mean a belt drive control can be conducted precisely because the correction value data obtained from a given position on the transfer belt 10 can be applied to the same given position.

As above described, the downsampling processing unit 607 includes the memory 607*a* and the correction value computing unit 611 includes the memory 611*a*. When data storing and reading operations for the memory 607*a* and the memory 611*a* is switched, the correction value storage control unit 610 and the correction value reading control unit 612 may be used as a switching unit. However, such control can be conducted by the CPU 501 if the memory 607*a* and the memory 611*a* are configured as DRAM (dynamic random access memory). Specifically, the CPU 501 may control such memories by asserting/negating a chip-enable signal connected to each of memories. Further, when controlling operation of data reading, each of memories can be controlled by asserting/negating an output-enable signal. Other than DRAM, SRAM (static random access memory) or SDRAM (synchronous dynamic random access memory) can be used as a memory.

Further, if the thickness fluctuation in the transfer belt 10 may not occur in one given rotation and downsampling data in such given rotation is same as downsampling data of the transfer belt 10 obtained in the previous rotation, the above described computing process according to the first exemplary embodiment can be conducted or such computing process can be cancelled.

Further, the correction value, obtained by using the latest amplitude/phase value and stored in a non-volatile memory disposed in the belt drive control unit 600 when the transfer belt 10 stops its rotation, can be stored in another way. For example, the correction value can be stored in the memory 611*a*, corresponding to the correction value area for the transfer belt 10.

A description is now given to a second exemplary embodiment with reference to FIGS. 12 to 15. In the second exemplary embodiment, a downsampling processing unit 808 (corresponding to the downsampling processing unit 607) includes two memories, and a correction value computing unit 813 (corresponding to the correction value computing unit 611) includes two memories as below described, in which the two memories can be alternately used for data processing.

Figure 12:
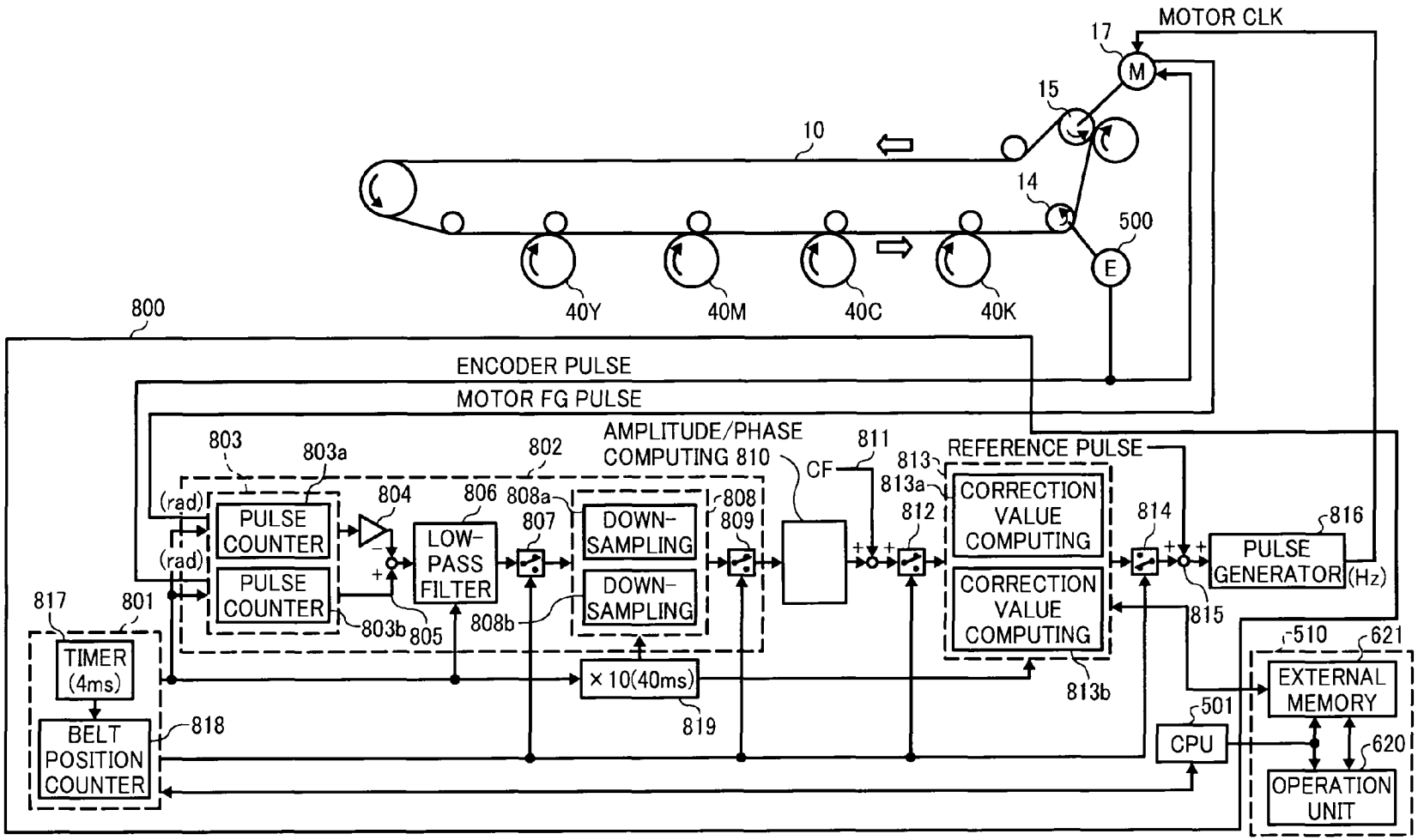
FIG. 12 illustrates a block diagram of a belt-drive control system according to a second and a third exemplary embodiments.

FIG. 12 shows a block diagram of a belt drive control unit 800 according to a second exemplary embodiment. The belt drive control unit 800 shown in FIG. 12 has some similar configurations for its devices as the belt drive control unit 600 shown in FIG. 10. Such similar devices are assigned with similar numbers or characters.

As shown in FIG. 12, the belt drive control unit 800 includes a pulse counter unit 803, a constant unit 804, a subtraction unit 805, a low-pass filter 806, a sampled data storage control unit 807, a downsampling processing unit 808, a sampled data reading control unit 809, a amplitude/phase computing unit 810, a correction factor computing unit 811, a correction value storage control unit 812, a correction value computing unit 813, a correction value reading control unit 814, a reference pulse supply unit 815, a pulse generator 816, and a count generation unit 801.

The pulse counter unit 803 includes pulse counters 803*a*/803*b* to count pulse numbers of the angular velocity of the drive motor 17 and the angular velocity of the first driven roller 14 detected by the encoder 500, respectively.

The constant unit 804 converts count number of the FG pulses of the drive motor 17 so that the converted count number can be compared with the count number of pulse signals of the encoder 500.

The subtraction unit 805 computes the difference of the count number of the FG pulses and pulse signals of the encoder 500.

The low-pass filter 806 removes high-frequency noise.

The sampled data storage control unit 807 controls an operation of storing subtraction results, transmitted from the low-pass filter 806, to the downsampling processing unit 808.

The downsampling processing unit 808 includes an odd-number rotation memory 808*a* and an even-number rotation memory 808*b*. The sampled data storage control unit 807 controls an operation of storing the subtraction results at the low-pass filter 806 to any one of the odd-number rotation memory 808*a* and the even-number rotation memory 808*b* alternately. The odd-number rotation memory 808*a* and the even-number rotation memory 808*b* alternately used as a downsampling memory may be corresponded to each rotation number of the transfer belt 10. The downsampling processing unit 808 conducts downsampling process for the subtraction results transmitted from the low-pass filter 806 and stores downsampling results for one rotation of the transfer belt 10 to the odd-number rotation memory 808*a* or the even-number rotation memory 808*b*.

The sampled data reading control unit 809 controls an operation of reading data from any one of the odd-number rotation memory 808*a* and the even-number rotation memory 808*b* storing the data processed by a downsampling process.

As shown in FIG. 12, the pulse counter unit 803 to the sampled data reading control unit 809 may be collectively referred as a sampling data acquisition unit 602.

The amplitude/phase computing unit 810 extracts thickness fluctuation in the transfer belt 10 from the downsampling results for one rotation of the transfer belt 10.

The correction factor computing unit 811 provides a correction factor "CF" to the amplitude/phase value.

The correction value storage control unit 812 controls an operation of storing the computed amplitude/phase value as correction value data to any one of an odd-number rotation memory 813*a* and an even-number rotation memory 813*b* provided in the correction value computing unit 813. The odd-number rotation memory 813*a* and the even-number rotation memory 813*b* may be corresponded to each rotation number or period of the transfer belt 10.

The correction value computing unit 813 computes correction value data based on the computed amplitude/phase value and prepares a data table.

The correction value reading control unit 814 controls an operation of reading the correction value data stored in the odd-number rotation memory 813*a* and the even-number rotation memory 813*b* alternately. The computed correction value data may be corresponded to each rotation number or period of the transfer belt 10.

The reference pulse supply unit 815 supplies a reference pulse "RP" to the correction value data read by the correction value computing unit 813.

The pulse generator 816 generates pulse signal to be supplied to the drive motor 17 using the reference pulse.

The count generation unit 801 includes a timer 817 and a belt position counter 818. The timer 817 may be 4-ms (milliseconds) timer. The belt position counter 818 detects a relative position of the transfer belt 10 rotating in one direction.

The CPU 501 sets a condition to the count generation unit 801 to control the timer 817 and the belt position counter 818.

In the sampling data acquisition unit 602, the pulse counter unit 803 counts pulse numbers of the angular velocity of the drive motor 17 and the angular velocity of the first driven roller 14 detected by the encoder 500.

The counting of pulse signals is conducted using a hardware, in which an edge of pulse is detected to measure the number of input of edges of pulse signals. Because resolution of pulse signals is different between the motor FG pulse of the drive motor 17 and the pulse signals of the encoder 500, the constant unit 804 applies a constant K1 to the motor FG pulse to set a same resolution for the motor FG pulse and the pulse signals of the encoder 500. Then, a difference value between the pulses can be computed using the counted pulse numbers.

In a second exemplary embodiment, the belt drive control unit 800 includes the timer 817, which is a 4-ms timer. Accordingly, the pulse counter number can be checked every 4-ms timing. The computed difference value is then stored in a memory in the low-pass filter 806 with 4-ms cycle.

Although configurations of the transfer belt 10 and photoconductor drum 40 are different between FIG. 12 and FIG. 5, such difference does not affect features for the present invention, which is explained as exemplary embodiments. Such difference is within design variation of image forming apparatus.

Further, the computing timing of difference value is not limited to 4-ms, but other timing can be set. For example, high-speed sampling having a smaller sampling timing can be set to reduce quantization error on sampling. The sampling timing can be determined by a pulse generation cycle, which may be determined by the resolution of the motor FG pulse of the drive motor 17/pulse signal of the encoder 500 and a rotation speed of the transfer belt 10, and a storage capacity of an internal memory.

The motor FG pulse of the drive motor 17 and the pulse signal of the encoder 500 may include several periodical fluctuation components (e.g., periodical fluctuation in a rotating roller, periodical fluctuation in a drive gear, thickness fluctuation in the transfer belt 10). Therefore, the low-pass filter 806 is used to remove periodical fluctuation components except thickness fluctuation in the transfer belt 10 by conducting a moving average process for the computed difference value, obtained based on the 4-ms cycle sampling.

In a second exemplary embodiment, to remove the periodical fluctuation component of the drive roller 15, which is relatively close to the periodical fluctuation component of the transfer belt 10, a moving average process is conducted using a memory, which can store difference values for two rotations of the drive roller 15. Such removal process is conducted in advance because a computation error may occur when computing amplitude/phase value (to be described later) if a periodical fluctuation component closer to the periodical fluctuation component of the transfer belt 10 is superimposed to the periodical fluctuation component of the transfer belt 10.

After the moving average process for data, the data receives a data thinning process by a timer 819 having a 40-ms for downsampling. Specifically, the data for one rotation of the transfer belt 10 receives a data thinning process by the timer 819 every 40 ms, which is ten times of 4 ms, and then the data for one rotation of the transfer belt 10 is stored in the odd-number rotation memory 808*a* or the even-number rotation memory 808*b* in the downsampling processing unit 808.

Figure 13:
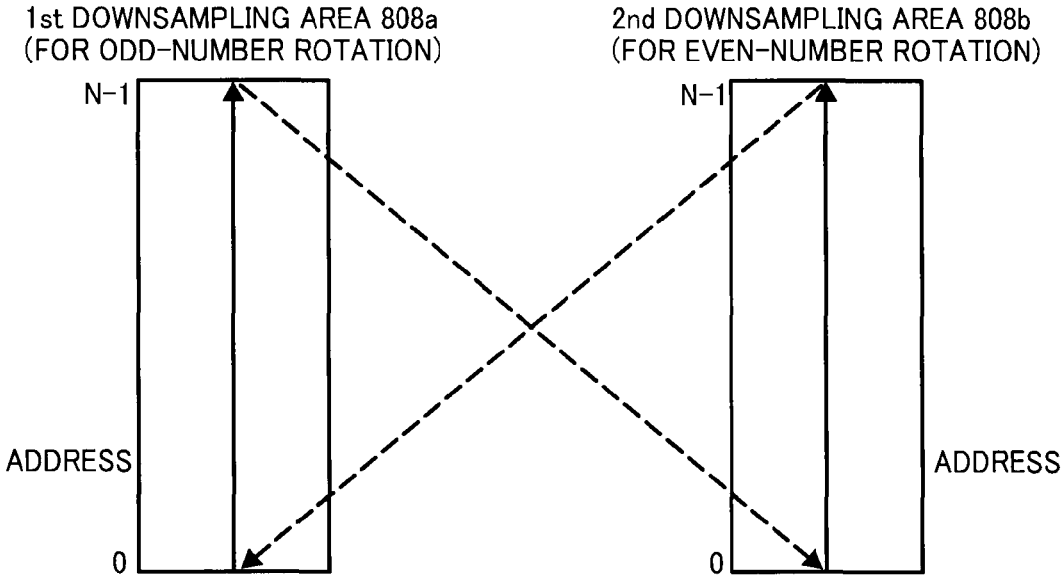
FIG. 13 illustrates two memories provided in a downsampling processing unit.

In a second exemplary embodiment, the downsampling processing unit 808 includes two memories (the odd-number rotation memory 808*a*, the even-number rotation memory 808*b*), which can store data for one rotation of odd-number rotation or one rotation of even-number rotation of the transfer belt 10. Data is, selectively, written to or read from the memories with a consideration of odd-number rotation or even-number rotation of the transfer belt 10. FIG. 13 shows a configuration of such memories.

A sampling thinning cycle of data may be determined as follows: in the moving average process, sampling of data is conducted in a relatively short cycle (e.g., 4 ms) to reduce quantization error on sampling; when computing amplitude/phase value for one rotation of the transfer belt 10 by the amplitude/phase computing unit 810, the number of data may not need be so large if such data do not include other fluctuation component. Accordingly, in a second exemplary embodiment, after the moving average process, the data receives the data thinning process using 40-ms cycle and stored in the memory.

Further, each of the memories in the down-sampling area can store data of the transfer belt 10 for one rotation. As described later, the amplitude/phase computing unit 810 may need a longer computing time when maximum amplitude value and phase value are computed using software. In view of such situation related to software performance, data of the transfer belt 10 for one rotation is obtained in a given rotation number (e.g., a first rotation). Then, based on the data obtained during the first rotation, the amplitude/phase value is computed during the next rotation number (e.g., a second rotation). Then, based on the computed amplitude/phase value, correction value data is computed. Then, in the further next rotation number (e.g., a third rotation), the correction value data is used for the belt-drive control. Such computing process according to a second exemplary embodiment will be described in detail in later.

To compute a phase value by using the amplitude/phase computing unit 608, a reference position on the transfer belt 10 needs to be checked and controlled. Specifically, the transfer belt 10 is put with a reference position mark on its face, and a sensor is used to detect the reference position of the transfer belt 10, by which the reference position of the transfer belt 10 during data sampling can be checked. The pulse count number can be checked using the 4-ms timer, and a timing, which starts a computation of difference value, can be counted from a virtual reference position of the transfer belt 10. Hereinafter, such virtual reference position is referred as a "virtual home position VHP" of the transfer belt 10. Accordingly, data for the transfer belt 10 rotating at a given speed is counted with 4 ms-interval for each of the rotation of the transfer belt 10 using the "virtual home position VHP" as a reference position. Based on the reference position (virtual home position VHP), any one of the odd-number rotation memory 808*a* and the even-number rotation memory 808*b* is alternately selected for downsampling data for the transfer belt 10 depending on the rotation number of the transfer belt 10.

For example, the virtual home position VHP of the transfer belt 10 may be determined as below. If a phase difference "$\tau$" for one rotation of the transfer belt 10 is set to "$2\pi$" as shown in FIG. 7, an accumulated rotation angle of the drive roller 15, an accumulated rotation angle of the encoder 500 disposed near the first driven roller 14, and a signal generated based on a 4-ms cycle clock signal of the timer 817 may be used to compute one rotation of the transfer belt 10 to compute the virtual home position VHP of the transfer belt 10.

After storing data of the transfer belt 10 for one rotation in the memory of the downsampling processing unit 808, the amplitude/phase computing unit 810 computes a phase value and a maximum amplitude value at the reference position VHP. The amplitude/phase value can be computed using higher-order component of periodical fluctuation component of the transfer belt 10. For example, in the second exemplary embodiment, the amplitude/phase value may be computed using first, second, and third-order component as similar to the first exemplary embodiment.

After computing the amplitude/phase value for the first to third components, which may be erroneously detected at the driven roller 14, a composite waveform having each of the components is computed using a sine function, and the correction value computing unit 813 computes a correction table for one rotation of the transfer belt 10.

Figure 14:
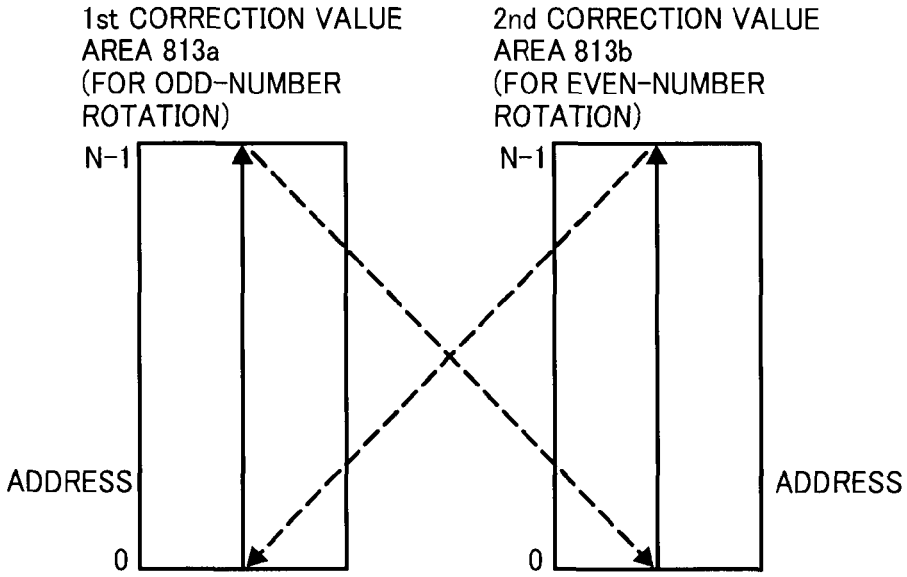
FIG. 14 illustrates two memories provided in a correction value computing unit.

As similar to the downsampling processing unit 808, the correction value computing unit 813 includes the odd-number rotation memory 813*a* and the even-number rotation memory 813*b* for the odd-number rotation and even-number rotation of the transfer belt 10 respectively. Any one of the odd-number rotation memory 813*a* and the even-number rotation memory 813*b* can be alternately selected for data writing and reading for the transfer belt 10 with a consideration of odd-number rotation or even-number rotation of the transfer belt 10. FIG. 14 shows a configuration of such memories.

After computing the correction table using the correction value computing unit 813, the pulse generator 816 generates a pulse signal to be output to the drive motor 17. When generating the pulse signal, any one of the odd-number rotation memory 813*a* and the even-number rotation memory 813*b* in the correction value computing unit 813 is alternately selected to read data of the transfer belt 10 with a consideration of odd-number rotation or even-number rotation of the transfer belt 10.

The value computed by the correction value computing unit 813 is based on the difference value between the motor FG pulse of the drive motor 17 and the pulse signal of the encoder 500 measured in 4-ms cycle. By converting the computed value computed by the correction value computing unit 813 into a frequency and adding the frequency to an original reference frequency, a frequency to be supplied to the drive motor 17 is determined. Based on such frequency, a pulse signal to be supplied to the drive motor 17 can be generated.

The above-described processes are repeated for each of the rotation of the transfer belt 10 to control the moving velocity of the transfer belt 10 at a constant level. As above described, the above-described processes includes measurement of the motor FG pulse of the drive motor 17 and the pulse signal of the encoder 500; extraction of detection error of the first driven roller 14 due to thickness fluctuation in the transfer belt 10; setting a target frequency based on the detection error; and driving the drive roller 17 using PLL control.

A description is now given to a method of controlling a driving of the transfer belt 10 using the belt drive control unit 800 according to the second exemplary embodiment.

As shown in FIG. 12, the CPU 501 is provided in the belt drive control unit 800 of the image forming apparatus 100. When the CPU 501 instructs a driving request to the drive motor 17, the drive motor 17 starts to rotate, by which the transfer belt 10 can be rotated. The CPU 501 waits for some time until the transfer belt 10 can rotate at a stable condition. When such stable rotation of the transfer belt 10 is established, the CPU 501 instructs the pulse counter unit 803 to count the motor FG pulse of the drive motor 17 and the pulse signal of the encoder 500. Then the subtraction unit 805 subtracts the counted results to compute thickness fluctuation in the transfer belt 10. The CPU 501 also controls the sampled data storage control unit 807, the sampled data reading control unit 809, the correction value storage control unit 812, and the correction value reading control unit 814, in which data storing and reading for each of the rotation numbers of the transfer belt 10 and the count number of timer are conducted to the relevant memory.

With reference to FIG. 15, a description is now given to data storing and reading process to the memories in the down-sampling processing unit 808 and the correction value computing unit 813.

As above described, the downsampling processing unit 808 includes the odd-number rotation memory 808*a* and the even-number rotation memory 808*b*, and the correction value computing unit 813 includes the odd-number rotation memory 813*a* and the even-number rotation memory 813*b*. The odd-number rotation memory 808*a* and the even-number rotation memory 808*b* of the downsampling processing unit 808 respectively correspond to a first down-sampling area and a second down-sampling area shown in FIG. 13. The odd-number rotation memory 813*a* and the even-number rotation memory 813*b* of the correction value computing unit 813 respectively correspond to a first correction value area and a second correction value area shown in FIG. 14.

The odd-number rotation memory 808*a* is used as a first downsampling data storage device. The even-number rotation memory 808*b* is used as a second downsampling data storage device. The odd-number rotation memory 813*a* is used as a first correction value storage device. The even-number rotation memory 813*b* is used as a second correction value storage device.

For the simplicity of explanation of data storing and reading timing to each of the memories, a simple sine wave is used for the thickness fluctuation in the transfer belt 10.

A description is now given to a method of belt drive control according to the second exemplary embodiment with reference to FIG. 15. FIG. 15 shows data storing and reading timing to memories set in a down-sampling area of the down-sampling processing unit 808 and a correction value area of the correction value computing unit 813.

A timer-count number "n" ("n" is zero or positive integer) indicates a count number counted by the timer 817 with 4-ms cycle. In an exemplary embodiment, the timer-count number "n" becomes 2020 counts for one rotation of the transfer belt 10, for example. Further, the belt rotation number "m" indicates the number of actual rotation of the transfer belt 10, in which "m" is zero or positive integer. Therefore, when the timer-count number "n" becomes 2020 counts, the belt rotation number "m" is counted for "one." Based on the belt rotation number "m", it is determined whether the transfer belt 10 is in the even-number rotation stage or the odd-number rotation stage.

When the drive motor 17 is activated to start a rotation of the transfer belt 10, the belt rotation number "m" is set to "1." Accordingly, the transfer belt 10 rotates from the odd-number rotation stage. Therefore, when the belt rotation number "m" is odd number, the transfer belt 10 is in the odd-number rotation stage, and when the belt rotation number "m" is even number, the transfer belt 10 is in the even-number rotation stage.

In step S0: After a driving request of the transfer belt 10 is issued by the CPU 501 and before driving the transfer belt 10, a set value (herein after "SP value") stored in an external memory 621 (e.g., non-volatile memory) is read. An operation unit 620 may be used to set the value in the external memory 621.

In step S1: the SP value is then stored in the odd-number rotation memory 813*a* (first correction value area) and the even-number rotation memory 813*b* (second correction value area) of the correction value computing unit 813 by using the correction value storage control unit 812. Steps S0 and S1 may be required because no computed result exists for the correction value when the transfer belt 10 rotated for the first time. Accordingly, a correction value (e.g., SP value) may need to be read from a data storage (e.g., external memory 621) storing the SP value in advance.

In step S2: The CPU 501 drives the drive motor 17 to rotate the transfer belt 10. A position of the transfer belt 10 when the transfer belt 10 starts to rotate is set as a virtual home position VHP of the transfer belt 10 (see dotted ellipse line in FIG. 15). A thickness profile related to a rotation of the transfer belt 10, rotating in one direction, is shown at the top of FIG. 15.

In step S3: During the first rotation of the transfer belt 10, the correction value reading control unit 814 selects the odd-number rotation memory 813*a* corresponding to the first correction value area of the correction value computing unit 813. Then, the correction value reading control unit 814 sequentially reads data of correction value for the first rotation of the transfer belt 10 with 40-ms cycle. Then, the pulse generator 816 generates and outputs a pulse signal to be supplied to the drive motor 17 (step S3*a*).

Simultaneously, the CPU 501 controls a counting process for the number of the pulse signal of the encoder 500 and the motor FG pulse of the drive motor 17, a computing of difference value of the pulses (i.e., between the pulse signal of the encoder 500 and the motor FG pulse of the drive motor 17), and a moving average process for the difference value of the pulses using a software installed in the belt drive control unit 800. Further, the sampled data storage control unit 807 sequentially stores sampling data of the difference value, which receives a data thinning process thinned by using 40-ms cycle, to the odd-number rotation memory 808*a* corresponding to the first down-sampling area of the downsampling processing unit 808 (step S3*b*).

When the timer-count number "n" counts 2021, the process goes to step S4. In step S4: when timer-count number "n" counts 2021, the belt rotation number "m" of the transfer belt 10 becomes "2" and the transfer belt 10 is shifted to a second rotation. The sampled data storage control unit 807 sequentially stores sampling data of the difference value, which receives a data thinning process thinned by using 40-ms cycle, to the even-number rotation memory 808*b*, corresponding to the second down-sampling area of the downsampling processing unit 808.

In step S5: while step S4 is concurrently conducted, the sampled data reading control unit 809 selects the odd-number rotation memory 808*a*, corresponding to the first down-sampling area, to sequentially read sampling data from the odd-number rotation memory 808*a*. Further, the amplitude/phase computing unit 810 computes amplitude value and phase value for the sampling data obtained during the first rotation of the transfer belt 10 to obtain correction value data (step S5*a*). After the computation, the correction value storage control unit 812 sequentially stores the correction value data obtained by the computation to the odd-number rotation memory 813*a*, corresponding to the first correction value area of the correction value computing unit 813 (step S5*b*).

In step S6: while step S5 is concurrently conducted, the correction value reading control unit 814 selects the even-number rotation memory 813*b*, corresponding to the second correction value area of the correction value computing unit 813, to sequentially read data of the correction value for one rotation of the transfer belt 10 from the even-number rotation memory 813*b* with 40-ms cycle. Then, the pulse generator 816 generates and outputs a pulse signal to be supplied to the drive motor 17.

In the second exemplary embodiment, correction value data sequentially read from the odd-number rotation memory

813*a* (first correction value area) or the even-number rotation memory 813*b* (second correction value area) with 40-ms cycle may have corresponding memory address. For example, a memory address corresponding to the virtual home position VHP of the transfer belt 10 is set to zero "0," for example.

When the timer-count number "n" counts 4041, the process goes to step S7. In step S7: when timer-count number "n" counts 4041, the belt rotation number "m" of the transfer belt 10 becomes "3" and the transfer belt 10 is shifted to a third rotation. The sampled data storage control unit 807 sequentially stores sampling data of the difference value, which receives a data thinning process thinned by using 40-ms cycle, to the odd-number rotation memory 808*a* corresponding to the first down-sampling area of the downsampling processing unit 808.

In step S8: while step S7 is concurrently conducted, the sampled data reading control unit 809 selects the even-number rotation memory 808*b*, corresponding to the second down-sampling area, to sequentially read sampling data from the even-number rotation memory 808*b*. Further, the amplitude/phase computing unit 810 computes amplitude value and phase value for the sampling data obtained during the second rotation of the transfer belt 10 to obtain correction value data (step S8*a*). After the computation, the correction value storage control unit 812 sequentially stores the correction value data obtained by the computation to the even-number rotation memory 813*b*, corresponding to the second correction value area of the correction value computing unit 813 (step S8*b*).

In step S9: while S8 is concurrently conducted, the correction value reading control unit 814 selects the odd-number rotation memory 813*a*, corresponding to the first correction value area of the correction value computing unit 813, to sequentially read correction value data for one rotation of the transfer belt 10 from the odd-number rotation memory 813*a* with 40-ms cycle. Then, the pulse generator 816 generates and outputs a pulse signal to be supplied to the drive motor 17.

When the timer-count number "n" counts 6061, the process goes to step S10. In step S10: when the timer-count number "n" counts 6061, the belt rotation number "m" of the transfer belt 10 becomes "4" and the transfer belt 10 is shifted to a fourth rotation. The sampled data storage control unit 807 sequentially stores sampling data of the difference value, which receives a data thinning process thinned by using 40-ms cycle, to the even-number rotation memory 808*b*, corresponding to the second down-sampling area of the down-sampling processing unit 808 until a memory address becomes an address corresponding to the timer-count number "n"=x, wherein the drive motor 17 stops at the timer-count number "n"=x.

In step S11: while step S10 is concurrently conducted, the sampled data reading control unit 809 selects the odd-number rotation memory 808*a*, corresponding to the first down-sampling area, to sequentially read sampling data from the odd-number rotation memory 808*a*. Further, the amplitude/phase computing unit 810 computes amplitude value and phase value for the sampling data obtained during the third rotation of the transfer belt 10 to obtain correction value data (step S11*a*). After the computation, the correction value storage control unit 812 sequentially stores the correction value data obtained by the computation to the odd-number rotation memory 813*a*, corresponding to the first correction value area of the correction value computing unit 813 (step S11*b*).

In step S12: while step S11 is concurrently conducted, the correction value reading control unit 814 selects the even-number rotation memory 813*b*, corresponding to the second correction value area of the correction value computing unit 813, to sequentially read correction value data from the even-number rotation memory 813*b* with 40-ms cycle until a memory address becomes an address corresponding to the timer-count number "n"=x (x is positive integer), wherein the drive motor 17 stops at the timer-count number "n"=x. Then, the pulse generator 816 generates and outputs a pulse signal to be supplied to the drive motor 17.

In step S13: when the transfer belt 10 stops, the correction value reading control unit 814 selects the even-number rotation memory 813*b*, corresponding to the second correction value area, and sequentially reads correction value data for one rotation of the transfer belt 10 with 40-ms cycle. Then, the CPU 501 stores the obtained correction value as "SP value" to the external memory 621 (non-volatile memory), connected to the operation unit 620 (see FIG. 12). Such "SP value" can be used when the drive motor 17 is activated for the next time.

When repeating the above process, the CPU 501 controls the sampled data storage control unit 807, the sampled data reading control unit 809, the correction value storage control unit 812, and the correction value reading control unit 814 for data storing and reading to the memories in the downsampling processing unit 808 and the correction value computing unit 813. As above described, the downsampling processing unit 808 includes two memories, each having a maximum address N−1 (N=0 or positive integer) that can store data for one rotation of the transfer belt 10, and the correction value computing unit 813 includes two memories, each having a maximum address N−1 (N=0 or positive integer) that can store data for one rotation of the transfer belt 10. Such memories can be alternately selected depending on the rotation number of the transfer belt 10, to which data storing and reading can be conducted.

With such a configuration, a timing, which can apply the correction value data obtained from the sampled data, can be started when the transfer belt 10 rotates for two times from the virtual home position VHP of the transfer belt 10. Accordingly, once the belt drive control is activated, the correction value data obtained from the sampled data can be applied to the odd-number rotation and the even-number rotation of the transfer belt 10. For example, the correction value data obtained from the sampled data, which is sampled from the first rotation of the transfer belt 10, can be applied when the belt rotation number of the transfer belt 10 becomes "3" (i.e., from the start of the third rotation of the transfer belt 10). Further, the correction value data obtained from the sampled data, which is sampled from the second rotation of the transfer belt 10, can be applied when the belt rotation number of the transfer belt 10 becomes "4" (i.e., from the start of the fourth rotation of the transfer belt 10). Such correction operation can be conducted until the drive motor 17 stops.

The "N" can be defined: N=T/C, in which "T" is time for one rotation of the transfer belt 10, and "C" is access cycle of memory. For example, If T=8 seconds and C 40 ms (0.04 sec), N=8/0.04=200.

As such, after sequentially reading the correction value data sequentially stored in the odd-number rotation memory 813*a* (first correction value area) with 40-ms cycle, the correction value data sequentially stored in the even-number rotation memory 813*b* (second correction value area) is sequentially read in 40-ms cycle. Such data reading process can be repeated as shown in FIG. 15. Accordingly, a timing for applying the correction value data can be shifted by interposing a time corresponding to one rotation of the transfer belt 10 between data acquisition and correction value data application, by which the correction value data obtained at a specific portion of the transfer belt 10 can be applied to the same specific portion on the transfer belt 10. Accordingly, the timing for applying the correction value to the transfer belt 10 may not be deviated from the specific portion, which may mean a belt drive control can be conducted precisely because the correction value data obtained from a given position on the transfer belt 10 can be applied to the same given position.

Such effect can similarly occur when the correction value data sequentially stored in the even-number rotation memory 813*b* (second correction value area), is read sequentially with 40-ms cycle, and then the correction value data sequentially stored in the odd-number rotation memory 813*a* (first correction value area), is sequentially read with 40-ms cycle.

As such, the belt drive control can be conducted for each one of rotations of the transfer belt 10 in the second exemplary embodiment, different from the first exemplary embodiment in which the belt drive control can be conducted for every two rotation of the transfer belt 10. Accordingly, the belt drive control can be conducted more effectively in the second exemplary embodiment.

Further, the above described processes shown in FIG. 15 may reduce operation load of the CPU 501. As above described, the downsampling processing unit 808 includes the odd-number rotation memory 808*a* and the even-number rotation memory 808*b*, and the correction value computing unit 813 includes the odd-number rotation memory 813*a* and the even-number rotation memory 813*b*, and data storing and reading process using such memories may reduce operation load of the CPU 501.

Further, by setting two memories and alternately accessing the two memories for storing and reading data, the correction value can be applied at any time when the transfer belt 10 rotates, by which the correction value computed from the thickness fluctuation in the transfer belt 10 can be applied to the transfer belt 10 at an earlier timing compared to a conventional correction method. Therefore, an effect of the thickness fluctuation in the transfer belt 10 to the image quality can be reduced.

Further, because the correction value computing unit 813 includes the odd-number rotation memory 813*a* and the even-number rotation memory 813*b*, load of computing amplitude/phase value by the CPU 501 may be reduced, by which a lower cost CPU can be used.

In the above described process, the odd-number rotation memory 808*a* (first down-sampling area) and the odd-number rotation memory 813*a* (first correction value area) are used as the odd-number rotation stage memory for the transfer belt 10; the even-number rotation memory 808*b* (second down-sampling area) and the even-number rotation memory 813*b* (second correction value area) are used as the even-number rotation stage memory for the transfer belt 10. However, the odd-number rotation memory 808*a*, the odd-number rotation memory 813*a*, the even-number rotation memory 808*b*, and the even-number rotation memory 813*b* can be used in other configuration.

For example, the first down-sampling area may be corresponded to the even-number rotation memory 808*b*, and the first correction value area may be corresponded to the even-number rotation memory 813*b*; the second down-sampling area may be corresponded to the odd-number rotation memory 808*a*, and the second correction value area may be corresponded to the odd-number rotation memory 813*a*.

The downsampling processing unit 808 includes the odd-number rotation memory 808*a* and the even-number rotation memory 808*b*, and the correction value computing unit 813 includes the odd-number rotation memory 813*a* and the even-number rotation memory 813*b*. When data storing and reading operations for the two memories in the downsampling processing unit 808 or the correction value computing unit 813 is switched, the sampled data storage control unit 807, the sampled data reading control unit 809, the correction value storage control unit 812, and the correction value reading control unit 814 may be used as a switching unit.

However, such control can be conducted by the CPU 501 if the odd-number rotation memory 808*a*, the even-number rotation memory 808*b*, the odd-number rotation memory 813*a*, and the even-number rotation memory 813*b* are configured as DRAM (dynamic random access memory). Specifically, the CPU 501 may control such memories by asserting/negating a chip-enable signal connected to each of memories. Further, when controlling operation of data reading, each of memories can be controlled by asserting/negating an output-enable signal. Other than DRAM, SRAM (static random access memory) or SDRAM (synchronous dynamic random access memory) can be used as a memory.

Further, if the thickness fluctuation in the transfer belt 10 may not occur in one given rotation and downsampling data in such given rotation is same as downsampling data of the transfer belt 10 obtained in the previous rotation, the above described computing process according to an exemplary embodiment can be conducted or such computing process can be cancelled.

Further, the correction value, obtained by using the latest amplitude/phase value and stored in a non-volatile memory disposed in the belt drive control unit 800 when the transfer belt 10 stops its rotation, can be stored in another way. For example, the correction value can be stored in the odd-number rotation memory 813*a* corresponding to the first correction value area for the transfer belt 10, or the even-number rotation memory 813*b* corresponding to the second correction value area for the transfer belt 10, wherein the correction value storage control unit 812 may select one of the memories.

A description is now given to a third exemplary embodiment with reference to FIGS. 12 and 16. The odd-number rotation memory 813*a* and the even-number rotation memory 813*b* in the correction value computing unit 813 can be alternately selected to sequentially store and read data depending on a rotation number of the transfer belt 10. In FIG. 16, the correction value data computed from the amplitude/phase value can be applied to the transfer belt 10 when the time "t," which is required for computing and storing data of correction value data, elapses from the virtual home position of each of the rotation number of the transfer belt 10.

As similar to the second exemplary embodiment, the downsampling processing unit 808 includes the odd-number rotation memory 808*a* and the even-number rotation memory 808*b*, which correspond to the first down-sampling area and the second down-sampling area shown in FIG. 13. The correction value computing unit 813 includes the odd-number rotation memory 813*a* and the even-number rotation memory 813*b*, which correspond to the first correction value area and the second correction value area shown in FIG. 14.

As similar to the second exemplary embodiment, the first downsampling data storage device may be the odd-number rotation memory 808*a* of the downsampling processing unit 808, and the second downsampling data storage device may be the even-number rotation memory 808*b* of the downsampling processing unit 808; The first correction value storage device may be the odd-number rotation memory 813*a* of the correction value computing unit 813, and the second correction value storage device may be the even-number rotation memory 813*b* of the correction value computing unit 813.

In the third exemplary embodiment, the correction value can be applied to the transfer belt 10 in consideration of a computing time for the correction value data. Specifically, a computing time (e.g., several seconds) required between the downsampling processing unit 808 and the correction value computing unit 813 using software may be shorter than a time for rotating the transfer belt 10 for one rotation. Accordingly, in the third exemplary embodiment, the correction value data can be applied to the transfer belt 10 at a relatively earlier timing (e.g., shortened time for correction value application), by which an effect of thickness fluctuation in the transfer belt 10 can be reduced effectively.

Specifically, a process for computing and storing the correction value data can be completed at a time "t" in one rotation number of the transfer belt 10 as indicated by an arrow shown in FIG. 16, wherein the time "t" is shorter than a time required for rotating the transfer belt 10 for one rotation. Accordingly, the computed correction value data can be stored in any one of the odd-number rotation memory 813*a* and the even-number rotation memory 813*b* in the correction value computing unit 813 when the time "t" elapses from the beginning of the one-rotation of the transfer belt 10. Therefore, correction value data corresponding to a timing of the time "t" may be read from any one of the odd-number rotation memory 813*a* and the even-number rotation memory 813*b* by shifting a to-be-read memory address in the odd-number rotation memory 813*a* and the even-number rotation memory 813*b*. Such memory address shifting can be conducted by checking a position of the transfer belt 10 corresponding to the time "t" from the virtual home position VHP of the transfer belt 10. Then, the correction value data can be used to conduct a feedback control for the motor CLK (clock) signal of the drive motor 17 through the pulse generator 816.

Such memory address shifting can be conducted using the timer 819 (e.g., 40-ms timer), for example. The 40-ms timer can be used to count numbers starting from the virtual home position VHP of the transfer belt 10. Accordingly, a count number corresponding to the time "t" from the virtual home position VHP of the transfer belt 10 can be counted, and the counted number for time "t" can be correlated to a given position of the transfer belt 10. By checking a given memory address corresponding to the time "t" in any one of the odd-number rotation memory 813*a* and the even-number rotation memory 813*b*, correction value data can be read from the given address sifted from a reference address in any one of the odd-number rotation memory 813*a* and the even-number rotation memory 813*b* when the time "t" elapses from the VHP of the rotating transfer belt 10. Therefore, the motor CLK signal of the drive motor 17 can be effectively and precisely controlled during a given one-rotation period of the transfer belt 10.

Accordingly, even if color-to-color displacement occurs due to a transport speed variation of the transfer belt 10, which may be caused by the thickness fluctuation in the transfer belt 10, a correction process can be conducted with a shorter time.

Specifically, a time period that the correction value is not applied is a period between the VHP and the time "t" in one rotation of the transfer belt 10, wherein "t" can be set shorter than a time RT, required for rotating the transfer belt 10 for one rotation (t<RT). Accordingly, a feedback control for the motor CLK signal of the drive motor 17 can be stared when the time "t" in one rotation of the transfer belt 10 elapses from the VHP. Accordingly, a correction process for the transport speed variation of the transfer belt 10 can be conducted with a shorter time. Such time-reducing effect for applying the correction value data may be recognized by comparing data-read timing and operation load in FIG. 15 and FIG. 16.

A description is now given to a belt drive control method according to the third exemplary embodiment with reference to FIGS. 12 and 16.

As shown in FIG. 12, the CPU 501 is provided in the belt drive control unit 800 of the image forming apparatus 100. When the CPU 501 instructs a driving request to the drive motor 17, the drive motor 17 starts to rotate, by which the transfer belt 10 can be rotated. The CPU 501 waits for some time until the transfer belt 10 can rotate at a stable condition. When such stable rotation of the transfer belt 10 is established, the CPU 501 instructs the pulse counter unit 803 to count the motor FG pulse of the drive motor 17 and the pulse signal of the encoder 500. Then the subtraction unit 805 subtracts the counted results to compute thickness fluctuation in the transfer belt 10. For the simplicity of explanation of data storing and reading timing to each of the memories, a simple sine wave is used for the thickness fluctuation in the transfer belt 10.

In step S100: After a driving request of the transfer belt 10 is issued by the CPU 501 and before driving the transfer belt 10, a set value (herein after "SP value") stored in an external memory 621 (e.g., non-volatile memory) is read. An operation unit 620 may be used to set the value in the external memory 621.

In step S101: the SP value is then stored in the odd-number rotation memory 813*a* (first correction value area) and the even-number rotation memory 813*b* (second correction value area) of the correction value computing unit 813 by using the correction value storage control unit 812.

In step S102: The CPU 501 drives the drive motor 17 to rotate the transfer belt 10. A position of the transfer belt 10 when the transfer belt 10 starts to rotate is set as a virtual home position VHP of the transfer belt 10 (see dotted ellipse line in FIG. 16). A thickness profile related to a rotation of the transfer belt 10, rotating in one direction, is shown at the top of FIG. 16.

In step S103: During the first rotation of the transfer belt 10, the correction value reading control unit 814 selects the odd-number rotation memory 813*a* corresponding to the first correction value area of the correction value computing unit 813. Then, the correction value reading control unit 814 sequentially reads data of correction value for the first rotation of the transfer belt 10 with 40-ms cycle. Then, the pulse generator 816 generates and outputs a pulse signal to be supplied to the drive motor 17 (step S103*a*).

Simultaneously, the CPU 501 controls a counting process for the number of the pulse signal of the encoder 500 and the motor FG pulse of the drive motor 17, a computing of difference value of the pulses (i.e., between the pulse signal of the encoder 500 and the motor FG pulse of the drive motor 17), and a moving average process for the difference value of the pulses using a software installed in the belt drive control unit 800. Further, the sampled data storage control unit 807 sequentially stores sampling data of the difference value, which receives a data thinning process thinned by using 40-ms cycle, to the odd-number rotation memory 808*a* corresponding to the first down-sampling area of the downsampling processing unit 808 (step S103*b*).

When the timer-count number "n" counts 2021, the process goes to step S104. In step S104: when timer-count number "n" counts 2021, the belt rotation number "m" of the transfer belt 10 becomes "2" and the transfer belt 10 is shifted to a second rotation. The sampled data storage control unit 807 sequentially stores sampling data of the difference value, which receives a data thinning process thinned by using 40-ms cycle, to the even-number rotation memory 808*b*, corresponding to the second down-sampling area of the down-sampling processing unit 808.

In step S105: while step S104 is concurrently conducted, the sampled data reading control unit 809 selects the odd-number rotation memory 808*a*, corresponding to the first down-sampling area, to sequentially read sampling data from the odd-number rotation memory 808*a*. Further, the amplitude/phase computing unit 810 computes amplitude and phase value for the sampling data obtained during the first rotation of the transfer belt 10 to obtain correction value data (step S105*a*). After the computation, the correction value storage control unit 812 sequentially stores the correction value data obtained by the computation to the odd-number rotation memory 813*a*, corresponding to the first correction value area of the correction value computing unit 813 (step S105*b*).

In step S106: while step S105 is concurrently conducted, the correction value reading control unit 814 selects the even-number rotation memory 813*b*, corresponding to the second correction value area of the correction value computing unit 813, to sequentially read correction value data from the first memory address to a given memory address corresponding to the time "t" in one rotation of the transfer belt 10 from the even-number rotation memory 813*b* with 40-ms cycle. Then, the pulse generator 816 generates and outputs a pulse signal to be supplied to the drive motor 17.

In the third exemplary embodiment, correction value data sequentially read from the odd-number rotation memory 813*a* (first correction value area) or the even-number rotation memory 813*b* (second correction value area) with 40-ms cycle may have corresponding memory address. For example, a memory address corresponding to the virtual home position VHP of the transfer belt 10 is set to zero "0," for example.

In step S107: When the correction value storage control unit 812 completes a storing process of correction value data to the odd-number rotation memory 813*a* (step S105), corresponding to the first correction value area of the correction value computing unit 813, the correction value reading control unit 814 sequentially reads the correction value for one rotation of the transfer belt 10 from a given memory address corresponding to the time "t" in one rotation of the transfer belt 10 from the odd-number rotation memory 813*a* with 40-ms cycle. Then, the pulse generator 816 generates and outputs a pulse signal to be supplied to the drive motor 17.

The time when the correction value storage control unit 812 completes a storing process of correction value data to the odd-number rotation memory 813*a* is the time "t" which elapses from the time when the timer-count number "n" becomes 2021, at which reading/computing/storing of the correction value data can be completed. Accordingly, a to-be-read memory address is shifted in the odd-number rotation memory 813*a* so that the address corresponding to the time "t" can be read as a to-be-read first memory address in the odd-number rotation memory 813*a*.

When the timer-count number "n" counts 4041, the process goes to step S108 while step S107 is concurrently conducted. In step S108: when timer-count number "n" counts 4041, the belt rotation number "m" of the transfer belt 10 becomes "3" and the transfer belt 10 is shifted to a third rotation. The sampled data storage control unit 807 sequentially stores sampling data of the difference value, which receives a data thinning process thinned by using 40-ms cycle, to the odd-number rotation memory 808*a* corresponding to the first down-sampling area of the downsampling processing unit 808.

In step S109: while step S108 is concurrently conducted, the sampled data reading control unit 809 selects the even-number rotation memory 808*b*, corresponding to the second down-sampling area, to sequentially read sampling data from the even-number rotation memory 808*b*. Further, the amplitude/phase computing unit 810 computes amplitude value and phase value for the sampling data obtained during the second rotation of the transfer belt 10 to obtain correction value data (step S109*a*). After the computation, the correction value storage control unit 812 sequentially stores the correction value data obtained by the computation to the even-number rotation memory 813*b*, corresponding to the second correction value area of the correction value computing unit 813 (step S109*b*).

In step S110: When the correction value storage control unit 812 completes a storing process of correction value data to the even-number rotation memory 813*b*, corresponding to the second correction value area of the correction value computing unit 813, at the time "t," the correction value reading control unit 814 sequentially reads correction value data for one rotation of the transfer belt 10 from a given memory address corresponding to the time "t" in one rotation of the transfer belt 10 from the even-number rotation memory 813*b* with 40-ms cycle. Then, the pulse generator 816 generates and outputs a pulse signal to be supplied to the drive motor 17.

The time when the correction value storage control unit 812 completes a storing process of correction value data to the even-number rotation memory 813*b* is the time "t" which elapses from the time when the timer-count number "n" becomes 4041, at which a reading/computing/storing of the correction value can be completed. Accordingly, a to-be-read memory address is shifted in the even-number rotation memory 813*b* so that the address corresponding to the time "t" can be read as a to-be-read first memory address in the even-number rotation memory 813*b*.

When the timer-count number "n" counts 6061, the process goes to step S111 while step S110 is concurrently conducted. In step S111: when the timer-count number "n" counts 6061, the belt rotation number "m" of the transfer belt 10 becomes "4" and the transfer belt 10 is shifted to a fourth rotation. The sampled data storage control unit 807 sequentially stores sampling data of the difference value, which receives a data thinning process thinned by using 40-ms cycle, to the even-number rotation memory 808*b*, corresponding to the second down-sampling area of the downsampling processing unit 808 until a memory address becomes a address corresponding to the timer-count number "n"=x, wherein the drive motor 17 stops at the timer-count number "n"=x.

In step S112: while step S111 is concurrently conducted, the sampled data reading control unit 809 selects the odd-number rotation memory 808*a*, corresponding to the first down-sampling area, to sequentially read sampling data from the odd-number rotation memory 808*a*. Further, the amplitude/phase computing unit 810 computes amplitude value and phase value for the sampling data obtained during the third rotation of the transfer belt 10 to obtain correction value data (step S112*a*). After the computation, the correction value storage control unit 812 sequentially stores the correction value data obtained by the computation to the odd-number rotation memory 813*a*, corresponding to the first correction value area of the correction value computing unit 813 (step S112*b*).

In step S113: the sampled data reading control unit 809 sequentially reads correction value data from the odd-number rotation memory 813*a*, in which data is read from a memory address corresponding the time "t" to a memory address corresponding to the timer-count number "n"=x with 40-ms cycle, wherein the drive motor 17 stops when the timer-count number "n"=x. Then the pulse generator 816 generates and outputs a pulse signal to be supplied to the drive motor 17.

In step S114: when the transfer belt 10 stops, the correction value reading control unit 814 selects the even-number rotation memory 813*b*, corresponding to the second correction value area, and sequentially reads correction value data for one rotation of the transfer belt 10 from the even-number rotation memory 813*b*. Then, the CPU 501 stores the obtained correction value as "SP value" to the external memory 621 (non-volatile memory), connected to the operation unit 620 (see FIG. 12). Such "SP value" can be used when the drive motor 17 is activated for the next time.

As shown in FIG. 16, a correction process for thickness fluctuation in the transfer belt 10 can be conducted with a following timing: The correction value data can be applied to the transfer belt 10 when a data reading time and computing time of sampling data for one of the memories in the downsampling processing unit 808 is completed and then when the correction value data is stored in one of the memories in the correction value computing unit 813. For example, in case of applying the correction value to the transfer belt 10 using the sampled data of the first rotation of the transfer belt 10, the correction value can be applied at a time that is computed by adding a time for step 103 and a time for step 105. Accordingly, a total time of step 103 and step 105 elapses when the correction value can be applied. With such a configuration, the CPU 500 can conduct a belt drive control for the transfer belt 10 precisely at an earlier timing, and the CPU 500 may conduct such belt drive control with reduced operation load.

Such an effect may be obtained because two memories in the downsampling processing unit 808 or in the correction value computing unit 813 can be alternately controlled. As above described, the downsampling processing unit 808 includes the odd-number rotation memory 808*a* and the even-number rotation memory 808*b*, and the correction value computing unit 813 includes the odd-number rotation memory 813*a* and the even-number rotation memory 813*b*.

In a timing chart shown in FIG. 15, the correction value, obtained for the first rotation of the transfer belt 10 by sampling, can be applied for controlling a moving velocity of the transfer belt 10 when the transfer belt 10 is shifted to the third rotation. On one hand, in a timing chart shown in FIG. 16, the correction value, obtained for the first rotation of the transfer belt 10 by sampling, can be applied for controlling a moving velocity of the transfer belt 10 when the transfer belt 10 is shifted to the second rotation and then the time t (sec) elapses in the second rotation.

In the above described exemplary embodiments, the SP value can be stored in the external memory 621, connected to the operation unit 620 (see FIG. 12), wherein correction value data can be input using the operation unit 620; or the previous correction value obtained in the previous belt operation can be stored in the external memory 621. In the above described exemplary embodiments, correction value data for one rotation of the transfer belt 10 may be read from the external memory 621 and used as a new correction value data for the first one rotation of the transfer belt 10 when the transfer belt 10 is started to rotate.

Figure 17:
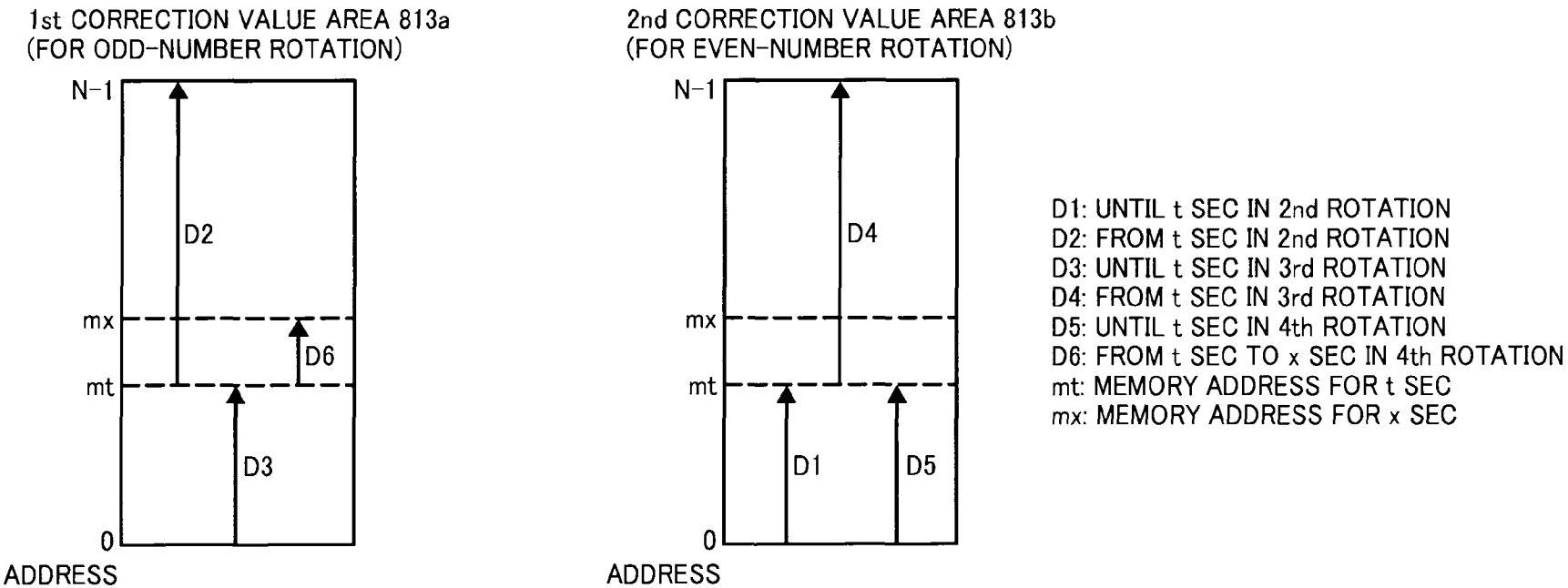
FIG. 17 shows two memories used for storing correction value area, in which correction value data is read from the memories by shifting memory address.

In the third exemplary embodiment, as shown in FIG. 17, the odd-number rotation memory 813*a* and the even-number rotation memory 813*b* in the correction value computing unit 813 may have an address-shifted condition. Such address-shifted condition may be controlled by the sampled data storage control unit 807, the sampled data reading control unit 809, the correction value storage control unit 812, or the correction value reading control unit 814. Specifically, the correction value storage control unit 812 or the correction value reading control unit 814 may be used to control the address-shifted condition. Such control is conducted based on the belt rotation number "m" of the transfer belt 10, the timer-count number "n", and memory address number.

FIG. 17 shows memories corresponding to the first and the second correction value area, in which data storing and reading are conducted, and the odd-number rotation memory 813*a* corresponds to the first correction value area; the even-number rotation memory 813*b* corresponds to the second correction value area.

When the belt rotation number "m" of the transfer belt 10 is "2" in FIG. 16, the transfer belt 10 is in the second rotation, and then data is read from the memories as below. An example data reading process is explained with reference to FIG. 17.

In step S106, the even-number rotation memory 813*b* is sequentially read from a memory address=0 to a memory address=mt (memory address corresponding to the time "t") during the second rotation of the transfer belt 10 (see D1 in FIG. 17). Then, in step S107, the odd-number rotation memory 813*a* is sequentially read from the memory address=mt to a last memory address=N−1 (N is 0 or positive integer) (see D2 in FIG. 17) and then from the memory address=0 to the memory address=mt (see D3 in FIG. 17) during the second and third rotations of the transfer belt 10. Such memory address control indicates that the two memories are alternately selected depending on the rotation number of the transfer belt 10.

Then, in step S110, the even-number rotation memory 813*b* is selected and sequentially read from the memory address=mt to the last memory address=N−1 (see D4 in FIG. 17) and then from the memory address=0 to the memory address=mt (see D5 in FIG. 17) during the third and fourth rotations of the transfer belt 10.

Then, as shown in FIG. 17 and in step S113, the odd-number rotation memory 813*a* is selected and sequentially read from the memory address=mt to a memory address mx= (memory address corresponding to time corresponding to "x") (see D6 in FIG. 17) during the fourth rotation of the transfer belt 10, wherein the drive motor 17 stops at the time "x". As such, the two memories are alternately selected and read depending on the rotation number of the transfer belt 10. A belt drive control operation according to the third exemplary embodiment can be completed by conducting the above processes.

In the third exemplary embodiment, a timing of data reading for the first correction value area and the second correction value area may not exactly match to the odd-number rotation and the even-number rotation of the transfer belt 10. Specifically, a timing of data reading for the first correction value area and the second correction value area may be switched at a given memory address (e.g., memory address "mt"), which is in the middle of the memory area.

Further, the above described process shown in FIG. 16 may preferably reduce operation load of the CPU 501. As above described, the downsampling processing unit 808 includes the odd-number rotation memory 808*a* and the even-number rotation memory 808*b*, and the correction value computing unit 813 includes the odd-number rotation memory 813*a* and the even-number rotation memory 813*b*, and data storing and reading process using such memories may reduce operation load of the CPU 501.

Further, in the third exemplary embodiment, the CPU 501 can conduct computing and storing of the correction value data with a computing time "t" in one rotation number of the transfer belt 10 as indicated by an arrow(s) shown in FIG. 16, wherein the time "t" is shorter than a time required for rotating the transfer belt 10 for one rotation. Accordingly, operation load of the CPU 501 during a given one rotation of the transfer belt 10 can be used efficiently while reducing the operation load of the CPU 501.

Further, by setting two memories and alternately accessing the two memories for storing and reading data, the correction value can be applied at any time when the transfer belt 10 rotates, by which the correction value computed from the thickness fluctuation in the transfer belt 10 can be applied to the transfer belt 10 at an earlier timing compared to a conventional correction method. Therefore, an effect of the thickness fluctuation in the transfer belt 10 to the image quality can be reduced.

Figure 18:
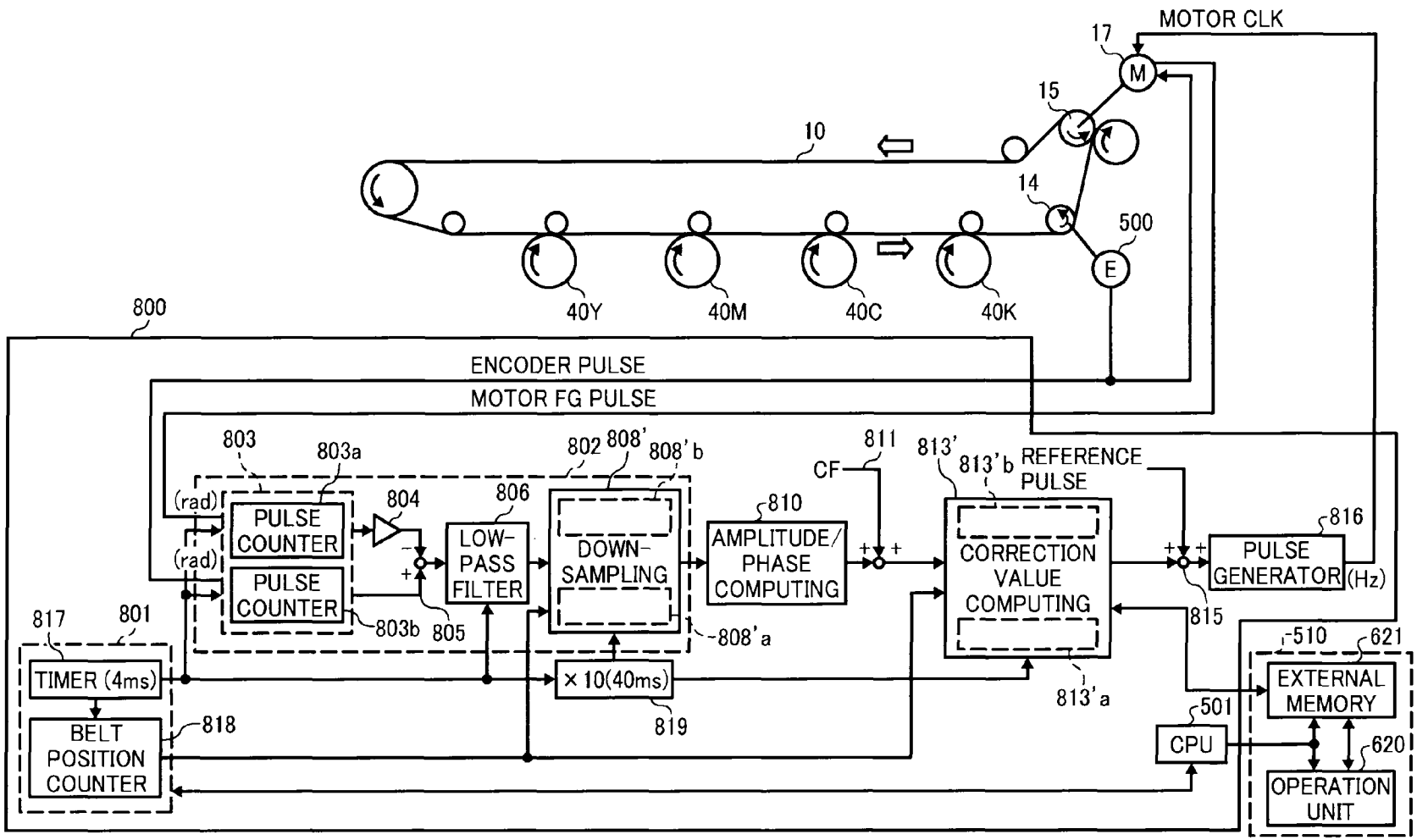
FIG. 18 shows another block diagram of a belt-drive control system according to a fourth exemplary embodiment according, in which one memory stores data for two rotation of the transfer belt.
Figure 19:
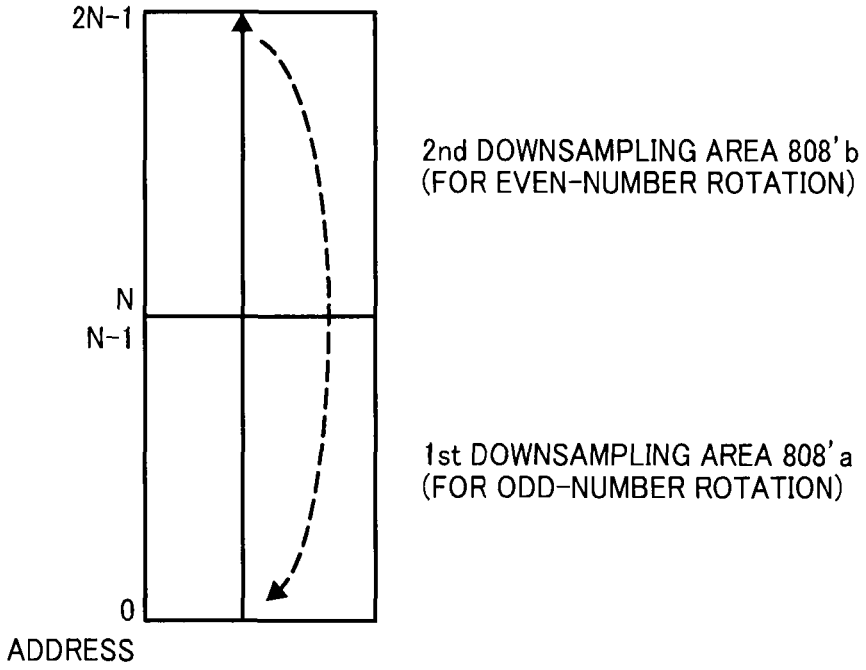
FIG. 19 shows one memory provided in a down-sampling area, which stores data for two rotation of the transfer belt.
Figure 20:
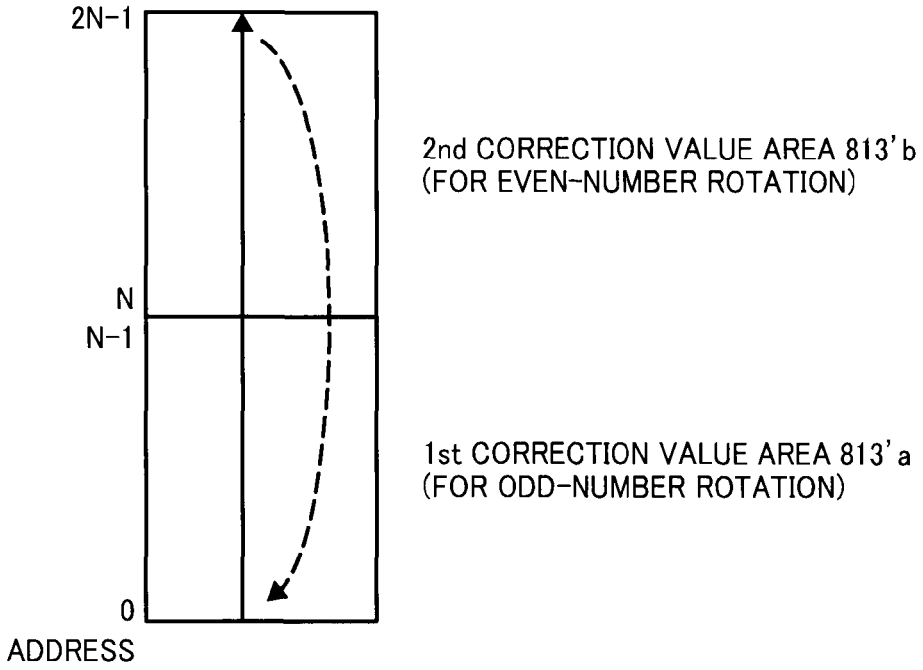
FIG. 20 shows one memory provided in a correction value area downsampling unit, which stores data for two rotation of the transfer belt.

A description is now given to a fourth exemplary embodiment with reference to FIGS. 18, 19, and 20, in which a downsampling processing unit 808' and a correction value computing unit 813' includes one memory. Such one memory may have capacity that can store data for two-rotation of the transfer belt 10 as shown in FIGS. 19 and 20.

Different from the second and third exemplary embodiments, the first downsampling data storage device may be a memory 808'*a* provided in the downsampling processing unit 808', and the second downsampling data storage device may be a memory 808'*b* provided in the downsampling processing unit 808'; the first correction value storage device may be a memory 813'*a* provided in the correction value computing unit 813', and the second correction value storage device may be a memory 813'*b* provided in the correction value computing unit 813'.

As similar to FIG. 12, FIG. 18 shows a block diagram of control system, in which the downsampling processing unit 808' includes one memory and the correction value computing unit 813' includes one memory, and each memory may have a memory area for two-rotation of the transfer belt 10. FIG. 19 shows a memory corresponded to the down-sampling area, and FIG. 20 shows a memory corresponded to the correction value area.

When such configured memory is used, a switching control for the memory area by using the sampled data storage control unit 807, the sampled data reading control unit 809, the correction value storage control unit 812, and the correction value reading control unit 814 shown in FIG. 12 can be omitted, by which the CPU 501 can conduct a control operation using software in a simplified manner.

As similar to the second and third exemplary embodiments, in the fourth exemplary embodiment, when a memory address area is divided in two sub-areas (first and second sub-areas), the odd-number rotation and the even-number rotation of the transfer belt 10 can be corresponded to any one the first and second sub-areas.

As above described in the first to fourth exemplary embodiments, even if a moving velocity of the transfer belt 10 fluctuates due to the thickness fluctuation in the transfer belt 10, such moving velocity fluctuation can be effectively and precisely controlled in a preferable level using a less expensive configuration.

As described in the first exemplary embodiment, the downsampling processing unit 607 and the correction value computing unit 611 include one memory, which has an memory area corresponded to one rotation of the transfer belt 10, for example. As described in the second and third exemplary embodiment, the downsampling processing unit 808 and the correction value computing unit 813 include two memories, each of which has an memory area corresponded to one rotation of the transfer belt 10, for example. As described in the third exemplary embodiment, the downsampling processing unit 808' and the correction value computing unit 813' include one memory, which has an memory area corresponded to two-rotation of the transfer belt 10, for example.

Further, the memory used for data storing and reading may be any types of memory. For example, a memory, which can erase data when one reading operation is conducted, can be used. Further, a memory, which can retain data until the data is erased by data-overwriting or by power shut-down to the memory, can be used.

Further, in the above described exemplary embodiments, a plurality of photoconductor drums 40Y, 40M, 40C, and 40K are arranged along the transfer belt 10 in a tandem manner, but the belt drive control unit according to exemplary embodiments can be employed for image forming apparatuses having another configuration.

Further, the transfer belt 10 may be an endless belt driven by a drive roller, in which the virtual home position VHP of the transfer belt 10 can be set. Such transfer belt 10 can be used in any types of transfer units using rollers for moving the belt in an image forming apparatus. Such image forming apparatus may be a color image forming apparatus, for example.

Further, in exemplary embodiments, an image is formed using the indirect transfer method, in which four toner color images are transferred onto the transfer belt 10 from the photoconductor drums 40Y, 40M, 40C, and 40K, and then the superimposed toner color images are transferred onto a transfer sheet. However, the above described exemplary embodiments can be applied to a direct transfer method, in which four toner color images are directly transferred from the photoconductor drums 40Y, 40M, 40C, and 40K onto a transfer sheet, which is transported by a transport belt. Further, the photoconductor drums 40Y, 40M, 40C, and 40K can be arranged in a tandem manner in any order, such as YMCK and MCYK, for example, wherein such color order can be determined based on design considerations. Further, the optical writing unit can use any light source, such as laser diode, LED (light emitting diode) array, or the like.

Further, the belt drive control unit 800 can use software programs to conduct the above-described processes. The programs can be available in a form of a recording medium. The recording medium may be FD (flexible disk), CD (compact disk)-ROM, CD-R (recordable), CD-RW (rewritable), DVD-ROM, DVD-R, DVD-RW, MO (Magneto-Optical disk), MD (MiniDisk), magnetic tape, hard disk in a server, for example.

As such, the belt drive control unit according to the exemplary embodiments can effectively and precisely control a belt-drive condition at a relatively earlier timing during an image forming process. Such belt drive control unit can be employed in any apparatus such as for example image forming apparatus, which may need a belt-drive control.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A belt drive control unit for controlling a rotation movement of a belt extendedly supported by a first rotatable device and a second rotatable device, the first rotatable device used as a drive-type rotatable device to support and rotate the belt, the drive-type rotatable device driven by a driver, the second rotatable device used as a driven-type rotatable device, the second rotatable device rotatable when the belt rotates, a rotation of the drive-type rotatable device being detected by a first detector as a first detection result, a rotation of the driven-type rotatable device being detected by a second detector as a second detection result, the rotation of the drive-type rotatable device being controlled in connection with thickness fluctuation in the belt at the driven-type rotatable device using the first detection result and the second detection result, the belt drive control unit comprising;

a sampling data acquisition unit to obtain sampling data by sampling a difference value between the first detection result and the second detection result;

a correction value generation unit to generate correction value data for each number of rotations of the belt based on the sampling data, the correction value data being used to correct a rotation of the drive-type rotatable device;

a correction value storage device to store the correction value data; and a correction value reading control unit to read the correction value data stored in the correction value storage device at a timing determined by number of rotations of the belt for controlling a rotation of the drive-type rotatable device, wherein:

the correction value storage device includes a first correction value storage device and a second correction value storage device to store correction value data, the belt drive control unit further comprises a correction value storage control unit to store the correction value data generated by the correction value generation unit to the first and second correction value storage devices alternately based on number of rotations of the belt; and the correction value reading control unit reads the correction value data stored in the first and the second correction value storage devices alternately according to number of rotations of the belt to control a rotation of the drive-type rotatable device.

2. The belt drive control unit according to claim 1, wherein, while the correction value storage control unit stores the correction value data to the first correction value storage device, the correction value reading control unit reads the correction value data stored in the second correction value storage device.

3. The belt drive control unit according to claim 1, wherein the correction value reading control unit reads correction value data stored in the first and second correction value storage devices alternately using a given timing during one rotation period of the belt as a data reading switching timing, in which 1) while the correction value storage control unit is storing correction value data of a given rotation number of the belt to the first correction value storage device, the correction value reading control unit is reading correction value data stored in the second correction value storage device, 2) when the correction value storage control unit completes storing of the correction value data to the first correction value storage device at the given timing, the correction value reading control unit stops reading the correction value data from the second correction value storage device at the given timing, and 3) the correction value reading control unit starts to read the correction value data stored in the first correction value storage device from a memory address corresponding to the given timing that the correction value reading control unit stops reading the correction value data from the second correction value storage device.

4. The belt drive control unit according to claim 1, wherein the sampling data acquisition unit comprises:

a first sampling data storage device and a second sampling data storage device to store sampling data;

a difference value computing unit to compute a difference value between the first detection result and the second detection result;

a sampling data storage control unit to store sampling data for each number of rotations of the belt, obtained by sampling the difference value, to the first and second sampling data storage devices alternately according to number of rotations of the belt; and a sampling data reading control unit to read the sampling data stored in the first and second sampling data storage devices alternately according to number of rotations of the belt.

5. The belt drive control unit according to claim 4, wherein, while the sampling data storage control unit stores sampling data to the first sampling data storage device, the sampling data reading control unit reads sampling data stored in the second sampling data storage device.

6. The belt drive control unit according to claim 1, wherein the correction value generation unit extracts amplitude and phase value corresponding to the thickness fluctuation in the belt using the sampling data, and computes the correction value data based on the amplitude and phase value.

7. An electrophotographic image forming apparatus comprising:

an exposure unit to form a latent image on an image bearing member by irradiating the image bearing member with light;

a development unit to develop the latent image on the image bearing member as a visible image;

a transfer unit to transfer the visible image from the image bearing member to a transfer belt or to a recording medium transported by a transport belt; and the belt drive control unit according to claim 1 to control a rotation of the transfer belt or the transport belt.

8. A belt drive control method for controlling a rotation movement of a belt extendedly supported by a first rotatable device and a second rotatable device, the first rotatable device used as a drive-type rotatable device to support and rotate the belt, the drive-type rotatable device driven by a driver, the second rotatable device used as a driven-type rotatable device, the second rotatable device rotatable when the belt rotates, a rotation of the drive-type rotatable device being detected by a first detector to as a first detection result, a rotation of the driven-type rotatable device being detected by a second detector as a second detection result, the rotation of the drive-type rotatable device being controlled in connection with thickness fluctuation in the belt at the driven-type rotatable device using the first detection result and the second detection result, the method comprising the steps of:

acquiring sampling data, in which a difference value between the first detection result and the second detection result are sampled to obtain sampling data;

generating correction value data, in which correction value data for correcting a rotation of the drive-type rotatable device is generated according to number of rotations of the belt based on the sampling data;

storing correction value data, in which the correction value data generated by the generation step is stored in a correction value storage device according to number of rotations of the belt; and reading correction value data, in which the correction value data stored in the correction value storage device is read according to number of rotations of the belt, wherein the correction value storage device includes a first correction value storage device and a second correction value storage device, in the step of storing correction value data, the correction value data generated by the generation step is stored to the first and second correction value storage devices alternately according to number of rotations of the belt, in the step of reading correction value data, the correction value data stored in the first and the second correction value storage devices is alternately read according to number of rotations of the belt.

9. A non-transitory computer-readable medium storing a program of belt drive control, comprising computer readable instructions, that when executed by a computer, instruct a belt drive control unit to carry out a method of controlling a rotation movement of a belt extendedly supported by a first rotatable device and a second rotatable device, the first rotatable device used as a drive-type rotatable device to support and rotate the belt, the drive-type rotatable device driven by a driver, the second rotatable device used as a driven-type rotatable device, the second rotatable device rotatable when the belt rotates, a rotation of the drive-type rotatable device being detected by a first detector to as a first detection result, a rotation of the driven-type rotatable device being detected by a second detector as a second detection result, the rotation of the drive-type rotatable device being controlled in connection with thickness fluctuation in the belt at the driven-type rotatable device using the first detection result and the second detection result, the method comprising the steps of:

acquiring sampling data, in which a difference value between the first detection result and the second detection result are sampled to obtain sampling data;

generating correction value data, in which correction value data for correcting a rotation of the drive-type rotatable device is generated according to number of rotations of the belt based on the sampling data;

storing correction value data, in which the correction value data generated by the generation step is stored in a correction value storage device according to number of rotations of the belt; and reading correction value data, in which the correction value data stored in the correction value storage device is read according to number of rotations of the belt, wherein the correction value storage device includes a first correction value storage device and a second correction value storage device, in the step of storing correction value data, the correction value data generated by the generation step is stored to the first and second correction value storage devices alternately according to number of rotations of the belt, in the step of reading correction value data, the correction value data stored in the first and the second correction value storage devices is alternately read according to number of rotations of the belt.

* * * * *